US006481698B1

(12) United States Patent
Calvin et al.

(10) Patent No.: US 6,481,698 B1
(45) Date of Patent: Nov. 19, 2002

(54) DUAL BARREL CARBURETOR FOR MOTORCYCLES

(75) Inventors: Michael E. Calvin, Alvaton, KY (US); Richard Keith Lindsey, Huff, KY (US); Doyle W. Graham, Morgantown, KY (US); Jasper C. Lindsey, Jr., Morgantown, KY (US); Laura Beth Cornett Rucker, Bowling Green, KY (US)

(73) Assignee: Holley Performance Products, Inc., Bowling Green, KY (US)

( * ) Notice: Subject to any disclaimer, the term of this patent is extended or adjusted under 35 U.S.C. 154(b) by 0 days.

(21) Appl. No.: 09/711,080

(22) Filed: Nov. 14, 2000

Related U.S. Application Data

(60) Provisional application No. 60/165,650, filed on Nov. 15, 1999.

(51) Int. Cl.[7] ..... F02M 19/10

(52) U.S. Cl. ..... 261/23.2; 261/34.2; 261/35

(58) Field of Search ..... 261/23.2, 34.2, 261/35, 66, 69.1, 69.2, 65, DIG. 68

(56) References Cited

U.S. PATENT DOCUMENTS

| | | | | |
|---|---|---|---|---|
| 4,204,585 | A | 5/1980 | Tsuboi et al. | 180/219 |
| 4,502,435 | A | 3/1985 | Tadokoro et al. | 123/198 F |
| 4,508,189 | A | 4/1985 | Kato | 180/219 |
| 4,913,855 | A | 4/1990 | Panzica | 261/50.1 |
| 5,128,071 | A | 7/1992 | Smith et al. | 261/34.2 |
| 5,480,592 | A | 1/1996 | Morrow | 261/44.4 |
| 5,591,383 | A | 1/1997 | Krup | 261/34.1 |
| 5,667,730 | A | 9/1997 | Barfield | 261/18.3 |
| 5,693,262 | A | 12/1997 | Percival | 261/23.2 |
| 5,776,377 | A | 7/1998 | Hammel, Jr. | 261/23.2 |
| 5,809,972 | A | 9/1998 | Grant | 123/478 |

*Primary Examiner*—Richard L. Chiesa
(74) *Attorney, Agent, or Firm*—Hunton & Williams

(57) ABSTRACT

This invention is directed to a dual barrel carburetor for a motorcycle. The preferred carburetor includes a novel combination of a fuel bowl assembly, a metering assembly, a main body assembly, and an air plenum assembly. The dual barrel carburetor includes annular discharge booster venturis associated with a main fuel delivery circuit. An idle circuit opens downstream of the throttle plates. A transfer circuit discharge port is positioned across the throttle plates. The combination of the idle, transfer and main fuel circuits ensures the smooth delivery of fuel throughout all operating conditions of the motorcycle engine. The plenum manifold assembly includes a pair of air passages in fluid communication with one another to permit a final opportunity to optimize the fuel delivery to the respective combustion chambers.

37 Claims, 16 Drawing Sheets

DUAL BARREL CARBURETOR FOR MOTORCYCLES

RELATED APPLICATIONS

Priority is claimed based on U.S. Provisional Application No. 60/165,650 entitled "Dual Barrel Carburetor for Motorcycle", filed Nov. 15, 1999.

FIELD OF THE INVENTION

This invention relates generally to the field of carburetors for internal combustion engines. More specifically, this invention relates to a dual barrel side draft carburetor for motorcycles.

BACKGROUND OF THE INVENTION

Motorcycles engines, like most internal combustion engines, require a proper mixture of fuel and air to be fed into the combustion chamber of the cylinders. A common device for regulating the air/fuel mixture and delivering it to the combustion chamber is a carburetor. The carburetor controls engine fuel and air input and therefore greatly influences power output. The carburetor mixes fuel and air in the correct proportions for engine operation and atomizes and vaporizes the fuel/air mixture to facilitate combustion. While fuel injection has replaced carburetors in many of today's vehicles, carburetors continue to be used in high performance vehicles (i.e., race cars) and in motorcycles, particularly where space, cost, or performance preferences dictate.

Carburetors often have the same basic structure: a fuel inlet and reservoir (the fuel bowl assembly), which takes in and holds fuel for metering in the proper proportions; a main body, including a throttle valve and air passage, which admits air in one end and discharges the fuel/air mixture from the other; and one or more fluid circuits connecting the fuel bowl assembly to the main body. The actual design and orientation of the structures varies widely depending on the size, configuration, and performance needs of the engine.

Motorcycles may employ a side draft carburetor. Various examples of side draft carburetors for use in motorcycles are shown in U.S. Pat. No. 5,480,592, issued to Morrow; U.S. Pat. No. 5,128,071, issued to Smith et al.; and U.S. Pat. No. 4,913,855, issued to Panzica, all of which are incorporated herein by reference.

But motorcycle engines may include one or more cylinders. Carburetors on motorcycles, including the carburetors disclosed in the aforementioned U.S. Patents, have conventionally been of the single barrel type. These single barrel carburetors must be designed to supply the appropriate amount of air and fuel to each cylinder of the motorcycle. This is often a difficult task. The manifolds for the different cylinders are usually of different lengths. A single barrel carburetor must be configured taking into account the compromise between feeding cylinders operating under different air/fuel delivery conditions. One solution proposed by U.S. Pat. No. 4,204,585 to Tsuboi et al., incorporated herein by reference, proposes using a carburetor for each cylinder of the motorcycle in the case of a multi-cylinder engine. But this increases the complexity of the bike, as well as requires accommodation in the engine envelope, which may already be cramped. In sum, carburetors for high performance motorcycles present specific design considerations not yet adequately met by prior art designs.

These and other drawbacks of prior art carburetors for motorcycles are overcome by the dual barrel carburetor of the preferred embodiments.

SUMMARY OF THE INVENTION

It is an object of the preferred embodiments to provide a duel barrel side draft carburetor for use in two cylinder motorcycle engines.

It is further an object of the preferred embodiments to provide a number of external adjustments and interchangeable parts to allow detailed calibration and customization of a carburetor for a particular user's performance needs. These adjustments and interchangeable parts allow the two cylinders to be tuned independently in a factory calibration.

It is further an object of the preferred embodiments to provide a plenum manifold with a plurality of carburetor/cylinder passages connected by auxiliary passages.

It is further an object of the preferred embodiments to provide an annular discharge booster venturi associated with each barrel of the carburetor.

It is further an object of the preferred embodiments to provide an improved method for manufacturing and calibrating a carburetor through a modular design with interchangeable parts.

It is further an object of the preferred embodiments to provide an improved motorcycle carburetor which provides more horsepower than stock carburetors and all other after-market replacement and performance carburetors presently on the market.

It is yet a further object of the preferred embodiments to provide a carburetor having "tunable" circuits, i.e., idle circuit, transfer circuit and main circuit, for each barrel of the carburetor implemented by having interchangeable metering restrictions to allow the fuel delivery rate to be factory calibrated.

It is still yet a further object of the preferred carburetor to provide an external fuel bowl sight glass to permit viewing of the float level without disassembling the carburetor; to provide an externally adjustable float level provided by an externally adjustable needle and seat assembly; to provide an externally interchangeable fuel inlet needle and seat assemblies to allow an increase or decrease in the speed of the fuel bowl fill rate; and to provide adjustable idle mixture screws.

A dual barrel carburetor for two cylinder motorcycle engines is an improvement over prior art single barrel carburetors inasmuch as the barrels, by virtue of dedicated fuel metering devices, may be tuned to optimize the performance of the engine. Likewise, a dual barrel carburetor that allows independent calibration is an improvement over prior art single barrel carburetors. Still further yet, a dual barrel carburetor that permits external adjustment of the fuel bowl fill rate, fuel bowl fill level, and idle fuel mixture is an improvement over the prior art. A plenum manifold that has separate passages from each barrel of the carburetor to each cylinder, but also has an opening between the passages to allow one cylinder to "borrow" a portion of its neighboring air/fuel mixture, is also an improvement over the prior art. Still further yet, an annular discharge booster venturi providing even fuel distribution is an improvement over the prior art.

The invention of the preferred embodiments is also directed to a method of manufacturing and calibrating dual barrel carburetors. The preferred method includes a modular design and interchangeable parts. This also is an improvement over the prior art.

The inventive carburetor may be either original equipment sold with the motorcycle or an after-market performance add-on to replace an existing carburetor on a motorcycle. In any event, dynamometer testing has unexpectedly revealed that the carburetor of the preferred embodiments delivers more horsepower than prior art stock carburetors, including original equipment and after-market add-ons.

These and other objects of the preferred embodiments are particularly achieved by a dual barrel carburetor assembly for a motorcycle. The carburetor has a main body forming a first body passage and a second body passage. Each body passage has an intake port, a discharge port, and a main venturi or constriction. A first butterfly throttle valve is disposed within the first body passage between the constriction and the discharge port. The first butterfly valve can be operated to regulate airflow through the first body passage. Similarly, a second butterfly throttle valve is disposed within the second body passage. It is also located between the constriction and the discharge port and can be operated to regulate airflow through the second body passage.

A fuel bowl assembly comprising a fuel intake valve and a fuel bowl body is also included. The fuel bowl body forms a reservoir for fuel. At least one fluid channel connects the reservoir in the fuel bowl to the first body passage and the second body passage. Fuel enters the carburetor assembly through the fuel intake valve and accumulates in the reservoir. Fuel is aspirated as it is combined with air entering the intake end of the first body passage and air entering the intake end of the second body passage. Finally, the air/fuel mixture exits the discharge ends of both body passages.

A plenum manifold may be attached to the main carburetor body to connect the main body to the engine cylinders. The manifold preferably has a first manifold passage and a second manifold passage. The manifold passages have respective discharge ports to the engine cylinders, as well as a main body associated with respective barrels in the main carburetor body. The manifold passages and the main body passages are aligned to form a substantially contiguous air fuel passageway through the carburetor assembly. The first manifold passage and the second manifold passage communicate with one another to allow the fuel/air mixture in each to pass between the two passages depending upon the operating condition of the bike.

In its most basic form, the invention of a preferred embodiment is directed to a carburetor assembly for a motorcycle comprising a main body forming a first body passage having an intake port, a discharge port, and a constriction; a second body passage having an intake port, a discharge port, and a constriction; a first valve disposed within said first body passage between the constriction and the discharge port of the said first body passage, said first valve operable to regulate airflow through said first body passage; a second valve disposed within said second body passage between the constriction and the discharge port of said second body passage, said second valve operable to regulate airflow through said second body passage; a fuel bowl assembly comprising a fuel intake valve and a fuel bowl body forming a reservoir; at least one fluid channel connecting said reservoir to said first body passage and said second body passage; and whereby when fuel enters said carburetor assembly through said fuel intake valve and accumulates in said reservoir, fuel is aspirated within said at least one fluid channel, and aspirated fuel is combined with air entering the intake end of the first body passage and air entering the intake end of the second body passage. Finally, the air fuel mixture exits the discharge end of the first body passage and the discharge end of the second body passage.

Other objects, features and advantages of the preferred embodiments will become apparent to those skilled in the art when the detailed description of the preferred embodiments is read in conjunction with the drawings appended here.

BRIEF DESCRIPTION OF THE DRAWING FIGURES

DETAILED DESCRIPTION OF PREFERRED EMBODIMENTS

Figure 1:
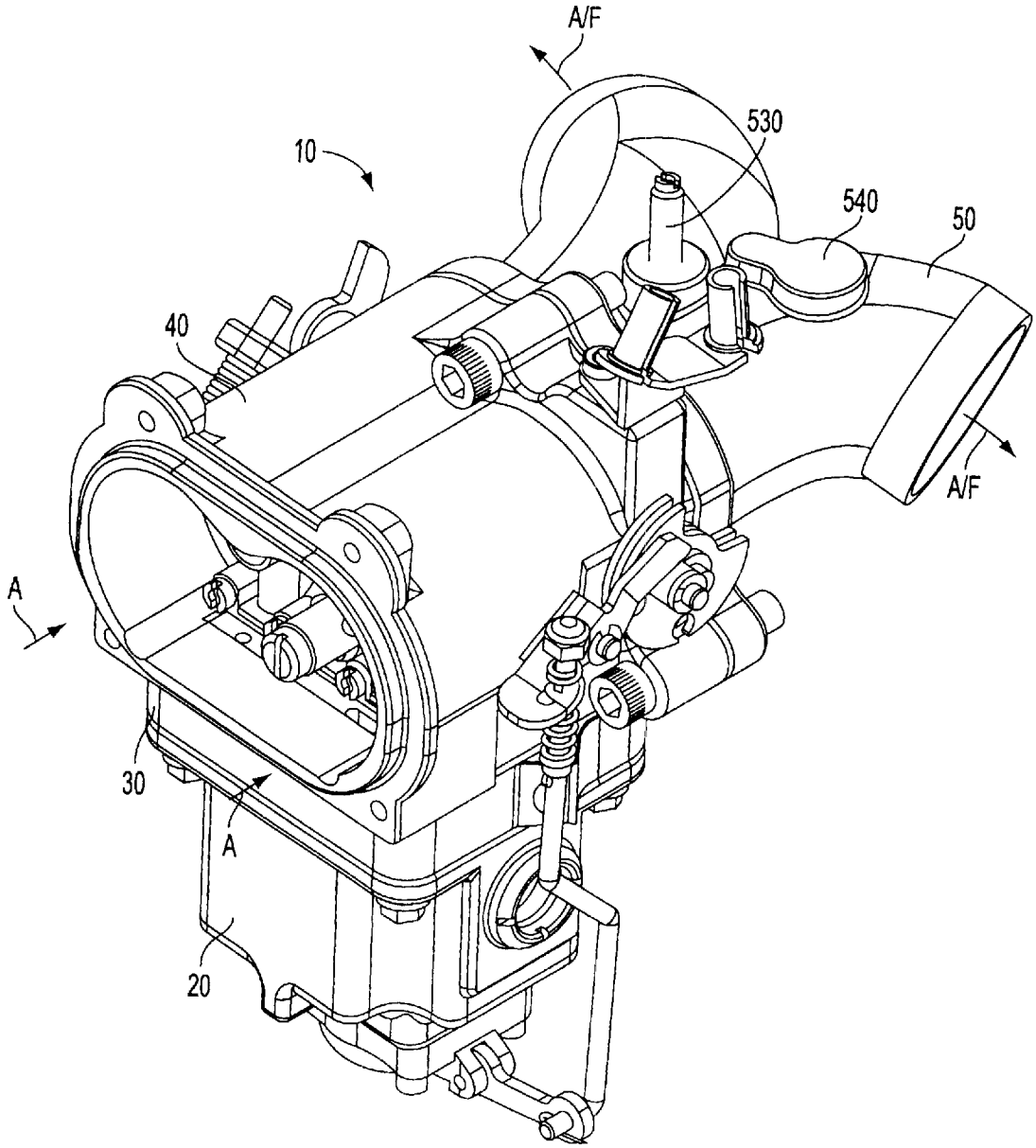
FIG. 1 is a perspective view of an example of the carburetor assembly of preferred embodiments.

The invention presents a new combination of elements, as well as incorporates new configurations for those elements, which in sum compliment one another in such a way to provide a new, useful and non-obvious improvement over prior art carburetors for motorcycles. The invention is not limited to the particular structures disclosed herein. Rather, as a natural consequence of reading this specification, other carburetor executions within the purview of the present invention will become readily apparent to those skilled in the art of carburetor design.

With reference to the drawing figures generally, and particularly to FIGS. 1–5, the dual barrel side draft carburetor assembly 10 for use in two cylinder motorcycle engines according to the present inventions consists of four main components or subassemblies. Namely, carburetor 10 includes a fuel bowl assembly 20, a metering body assembly 30, a main body assembly 40 and a plenum manifold assembly 50. Fuel bowl assembly 20 stores the fuel prior to delivery to metering body assembly 30. Metering body assembly 30 includes a series of hydraulic and gaseous communication passages which control the fuel delivery as a result of the rider-demanded throttle operating condition. Main body assembly 40 includes, among other components, the venturi and butterfly valves which are responsive to the rider-controlled hand throttle. Finally, plenum manifold assembly 50 is the communication passage through which the air/fuel mixture is delivered to the internal combustion engine. Of course, within each of these respective subassemblies are individual components, which collectively contribute to the optimum fuel delivery to the internal combustion engine. These subassembly components are discussed in detail below. Likewise, other external linkages and components are associated with certain of the subassemblies. These will be discussed in detail below as well.

Figure 6:
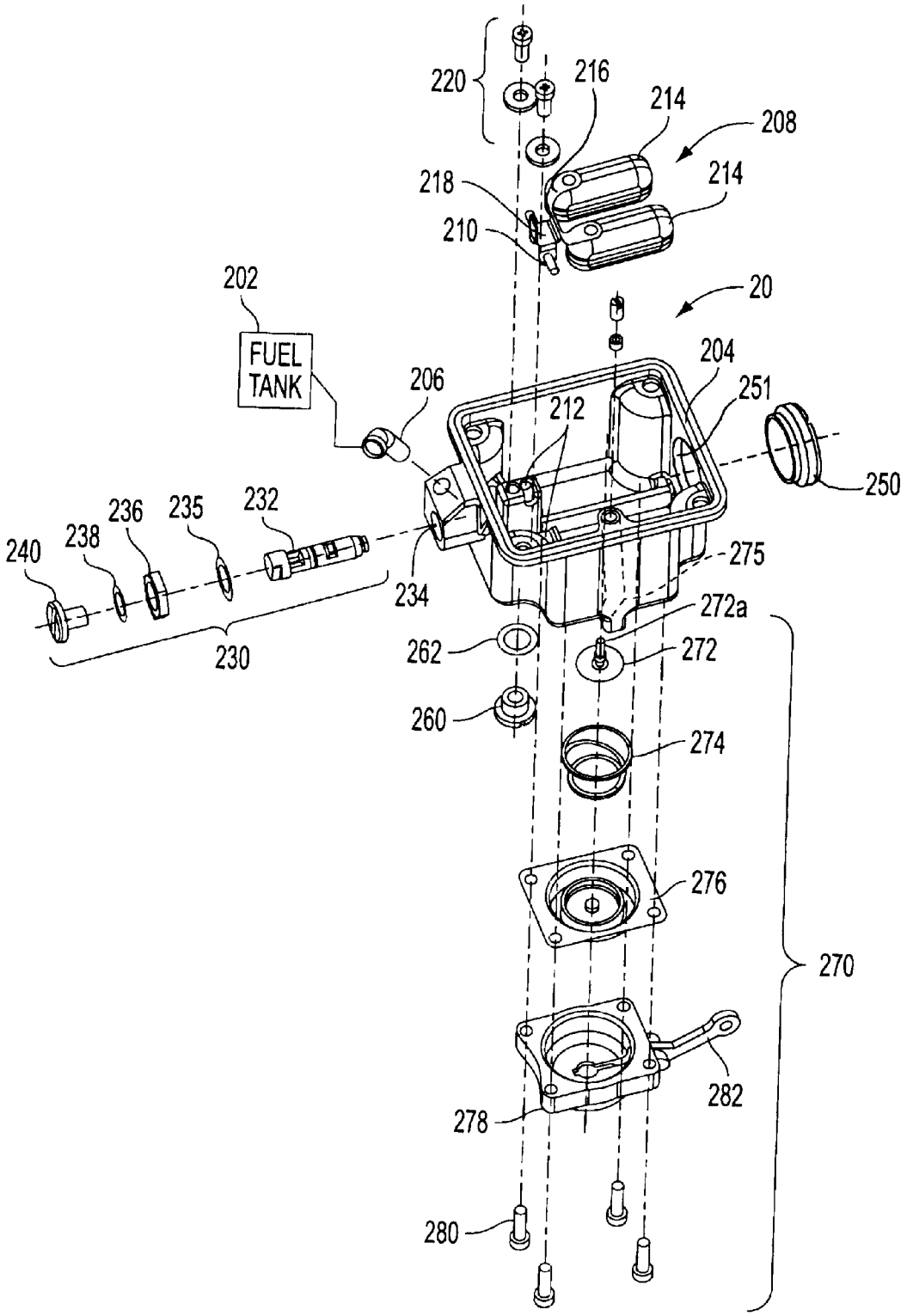
FIG. 6 is an exploded view of an example of the fuel bowl assembly of preferred embodiments.
Figure 7:
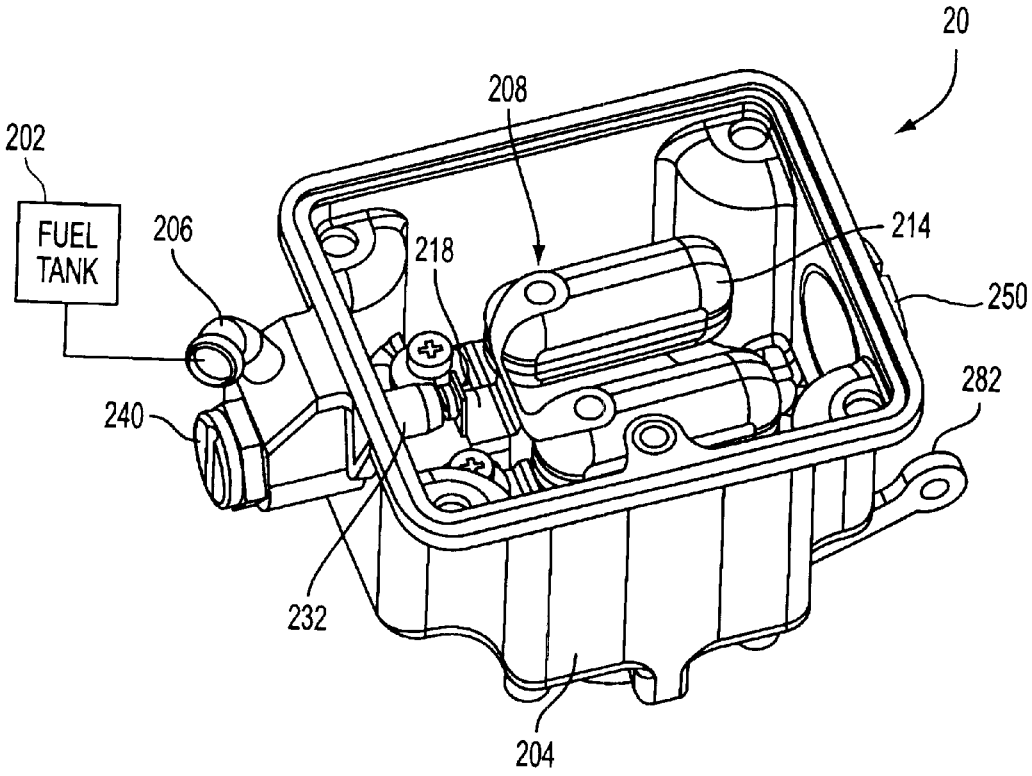
FIG. 7 is a perspective view of the assembled fuel bowl assembly of FIG. 6.
Figure 8:
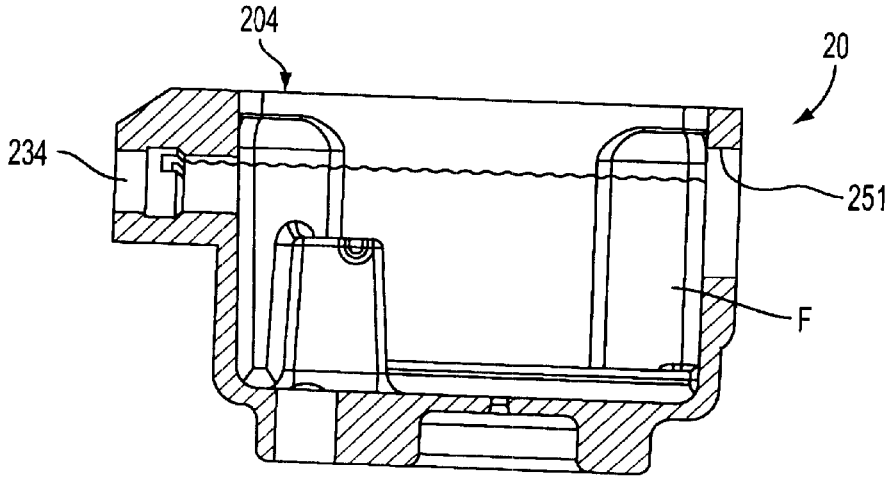
FIG. 8 is a partial sectional side view of the fuel bowl assembly of FIG. 6.

Now, taking each of these subassemblies in turn, with reference to FIGS. 6–8 in conjunction with FIGS. 1–5, the internal subcomponents of the fuel bowl assembly 20 are more particularly illustrated. Fuel bowl assembly 20 is the portion of the carburetor where fuel delivered from fuel tank 202 is stored prior to delivery to metering block assembly 30. Fuel bowl assembly 20 includes a tub body or storage basin 204 for storing fuel from fuel tank 202. Fuel bowl assembly 20 is located below metering body assembly 30 and main body assembly 40. The four walls and floor of fuel bowl body 204 form a reservoir or basin. Metering body assembly 30 provides a top to bowl body 204 to prevent the spillage of fuel from bowl body 204. Fuel from fuel tank 202 enters bowl body 204 via a tube 206. A float assembly 208 is rotatably attached by a float shaft 210 to a pair of float supports 212 formed in bowl body 204. Float assembly 208 includes a pair of floats 214 operatively attached to float shaft 210 through a float linkage 216. Linkage 216 includes a tab 218 extending upwardly from the portion thereof opposite float shaft 210. Float assembly 208 is secured to float supports 212 by a pair of attachment members, e.g., threaded screws and washers 220.

A fuel inlet and seat assembly 230 is mounted to the front of fuel bowl assembly 20. Fuel inlet and seat assembly 230 cooperates with float assembly 208 to permit the selective adjustment of the fuel level maintained in bowl basin 204. Fuel inlet and seat assembly 230 includes a needle and seat valve 232. A through-hole 234 extends entirely through the wall of bowl basin 204. Valve 232 is positioned in through hole 234. As best seen in FIG. 7, the distal end of valve 232 engages tab 218 formed on float assembly 208.

Referring back to FIG. 6, in order to assure the fluid tight integrity of bowl body 204, a fuel inlet adjustment nut gasket 235 is provided around the proximal end of valve 232. A fuel valve seat nut 236, a fuel valve seat screw gasket 238 and a fuel valve seat lock screw 240 operatively engage the distal end of valve 232. Fuel inlet and seat assembly 230 operatively engages and controls float assembly 208. Namely, upon rotation of fuel valve seat nut 236, the extent to which fuel inlet and seat assembly 230 protrudes into through-hole 234 is varied. Inasmuch as the distal end of fuel inlet and seat assembly 230 engages float assembly 208, rotation of fuel inlet and seat assembly 230 causes float assembly 208 to be adjusted up and down within bowl basin 204. Consequently, the amount of fuel maintained within bowl basin 204 may be selectively adjusted by the rider by rotation of fuel valve seat nut 236.

To that end, bowl basin 204 is provided with a sight window plug 250. Sight window plug 250 is threadably received in an opening 251 in the side wall of bowl basin 204 opposite to that in which through hole 234 if formed. Sight window plug 250 includes a looking glass through which the fuel F (FIG. 8) in bowl basin 204 may be seen. The window formed in plug 250 allows the fuel level to be precisely adjusted to specification without disassembly of the carburetor.

In the event bowl basin 204 requires drainage, such as in the event of carburetor servicing, a plug 260 is threadably received in the bottom of bowl basin 204. A gasket 262 provides fluid tight integrity to the threaded connection between bowl basin 204 and plug 260.

A pump diaphragm cover assembly 270 is positioned at the bottom of bowl basin 204. Assembly 270 serves as an accelerator pump assembly. In other words, upon quick acceleration or engine revving, assembly 270 delivers a shot of raw fuel to the carburetor so that the engine does not sputter due to an inadequate fuel supply. Assembly 270 includes an accelerator pump check valve 272, a diaphragm return spring 274, a diaphragm 276, a diaphragm cover 278, and screws 280. A diaphragm linkage 282 is pivotally attached to diaphragm cover 278. One end of linkage 282 engages to bottom of diaphragm 276. The other end of linkage 282 is operatively connected to a push rod 62 (FIG. 2) which, in turn, is operatively connected to the hand throttle. These respective linkages will become more apparent below.

Figure 2:
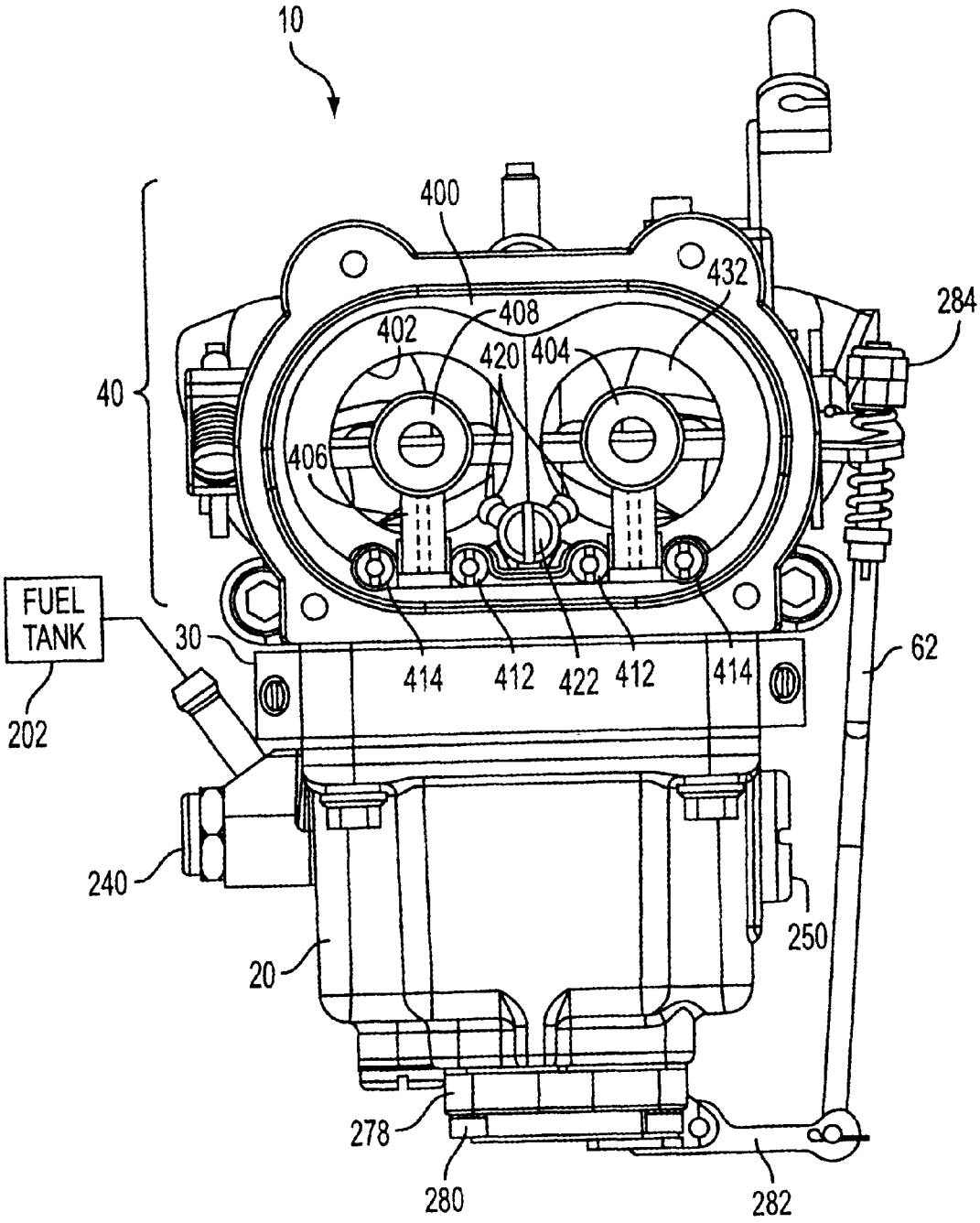
FIG. 2 is a front view of the carburetor assembly of FIG. 1.

As the rider demands acceleration from the motorcycle or revs the engine while in neutral, push rod 62 causes pivotal linkage 282 to compress diaphragm 276 in the direction of bowl basin 204. The accelerator pump check valve 272 includes a needle nose **272*a* which protrudes into the bottom of bowl basin 204. Under normal operation, i.e., when the engine is not being revved, needle nose 272*a* is lowered to a point where fuel from the bowl basin 204 flows around needle nose 272*a* and the disk at the bottom of needle nose 272*a*. A small pool of fuel is stored above diaphragm 276. A communication passage 275 extends along one of the exterior walls of the bowl basin 204. Communication passage 275 communicates with the fuel accumulated in diaphragm 276 and, as discussed in more detail below, communicates with accelerator pump discharge nozzles 420 (FIG. 2) through a fluid circuit extending through metering assembly 30. Consequently, upon rapid acceleration or revving, accelerator pump check valve 272, including its needle nose 272*a*, is caused to enter bowl basin 204. As a result, the disk portion of accelerator pump check valve 272 seats against the bottom of bowl basin 204 sealing off the fuel stored above the diaphragm 276 from the remainder of the fuel in bowl basin 204. The force of push rod 62 causes pivotal linkage 282 to compress diaphragm 276. This in turn causes the fuel stored above diaphragm 276 to be pumped through a series of communication passages including passage 275, and ultimately exit the accelerator pump discharge nozzles 420 (FIG. 2). This delivers a squirt of fuel to accelerator pump discharge nozzles 420 (FIG. 2) positioned adjacent booster venturi 404**.

The next component of the carburetor is metering body assembly 30. Metering body assembly 30 is situated between main body assembly 40 and fuel bowl assembly 20. Metering body assembly 30 includes a plate-like structure having several fluid circuits formed therein. Among other things, metering body assembly 30 conducts fuel, regulates the aspiration of the fuel, and controls the distribution of the fuel in response to the pressure gradients created in the maintain body assembly 40 fluid passages (to be described below).

Engines, including those in motorcycles, have different fuel requirements during different phases of operation, e.g., start-up, idle, acceleration, and normal cruising operation. But on an even more fundamental level, individual cylinders of an engine have different fuel demands. Fuel must be distributed to different locations in the main body passages in different air/fuel ratios. For this reason, the invention of the preferred embodiments provides multiple fuel channels, also referred to as circuits, in metering body assembly 30. Furthermore, individual cylinders of a motorcycle engine typically have slightly different operating conditions. For instance, in a typical "V" shaped two cylinder motorcycle engine, one cylinder is located "updraft" with respect to the other "downdraft" cylinder. In other words, one cylinder is positioned ahead of the other. As air flows past and cools the "updraft" cylinder, the heated air passes over the "downdraft" cylinder. Consequently, in a typical "V" shaped motorcycle engine, the "updraft" cylinder typically operates at a lower temperature than the "downdraft" cylinder. This temperature differential leads to different operating conditions and different fuel/air demands.

To address these different conditions and demands, the invention of the preferred embodiments provides each cylinder of the motorcycle with several dedicated fuel circuits. And each of these circuits are individually "tunable". In other words, the fuel delivery to the individual cylinders can be independently adjusted as a factory calibration to account for different operating conditions. Consequently, the dual barrel side draft carburetor of the preferred embodiments allows the fuel delivery rate to be optimized for each of the cylinders under the multiple operating conditions a bike encounters.

Figure 9:
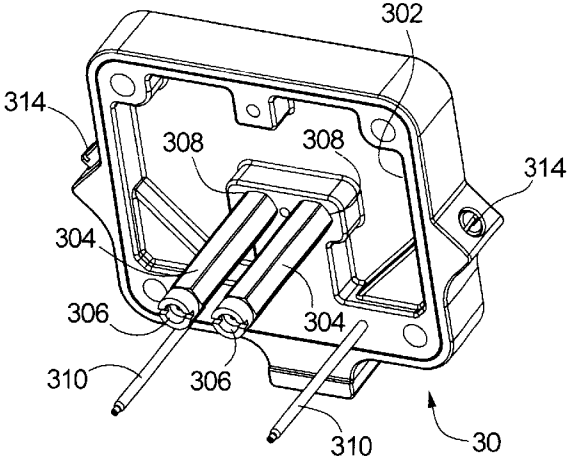
FIG. 9 is a perspective view of the bottom side of an example of the metering assembly according to the preferred embodiments.
Figure 10:
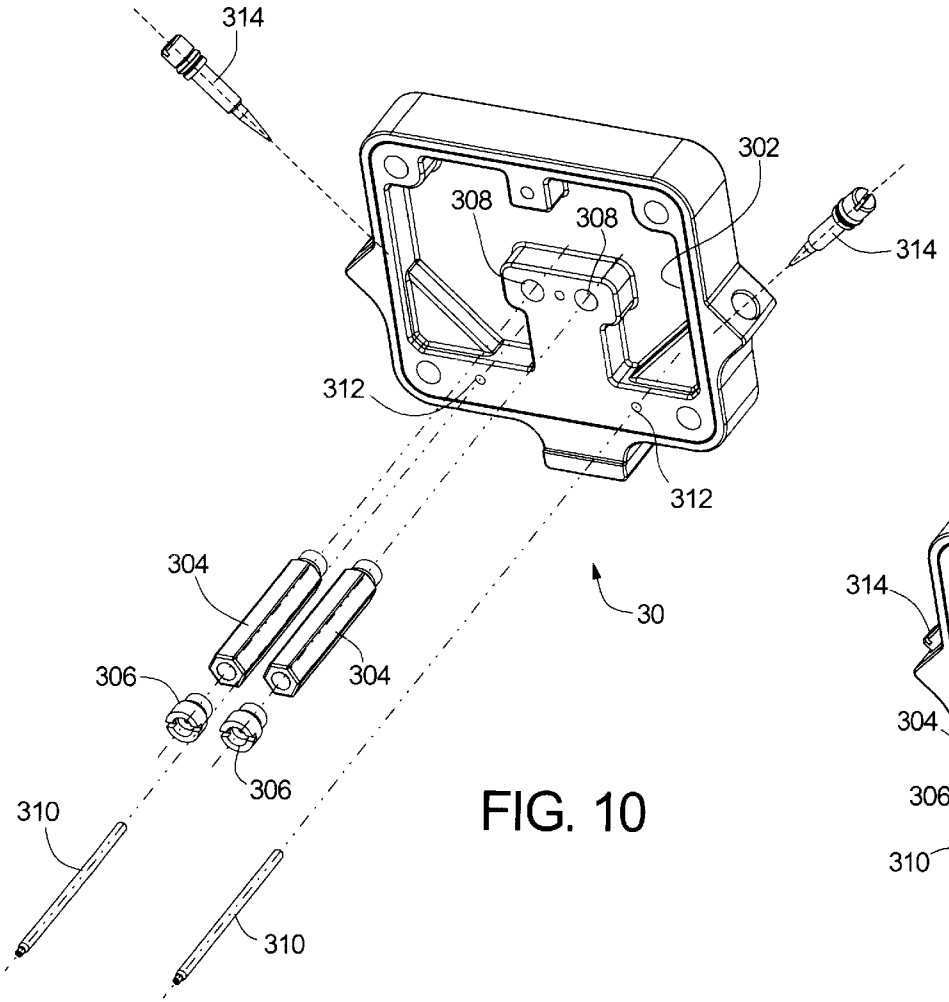
FIG. 10 is an exploded view of the bottom side of the metering assembly of FIG. 9.

With reference to FIGS. 9–12, in conjunction with FIGS. 1–5, fuel metering assembly 30 of the preferred embodiments is more particularly illustrated. FIGS. 9–10 illustrate a bottom side 302 of fuel metering assembly 30. Bottom side 302 forms a lid to bowl basin 204. A first pair of tubes 304, also known as main jet tubes, extend from bottom side 302 of fuel metering assembly 30. Jets 306 are attached to respective ends of tubes 304. Jets 306 are submersed in fuel F contained in bowl basin 204 (FIG. 8). Tubes 304 are received (e.g., threadingly received) in a pair of holes 308 formed through metering assembly 30. A second pair of tubes 310, also known as idle tubes, extend from bottom side 302 of fuel metering assembly 30. Idle tubes 310 are received (e.g., threadingly or force-fit) in a pair of holes 312 formed through metering assembly 30. The ends of tubes 310 are also submersed in fuel F. A pair of idle mixture screws or needles 314 are positioned on either side of the metering assembly 30. Idle mixture screws 314 may be manually adjusted by the rider to achieve optimum fuel delivery during idling conditions.

Idle tubes 310 are of substantially smaller diameter than tubes 304. That is because, as described in more detail below, idle tubes 310 serve the idle and off-idle fuel circuit, whereas main jet tubes 304 serve the main booster venturi feed circuit. Since idling requires substantially less fuel than either accelerating or cruising, it stands to reason that the feed tubes 310 for the idle circuit would be smaller than those for the main booster venturi.

Figure 11:
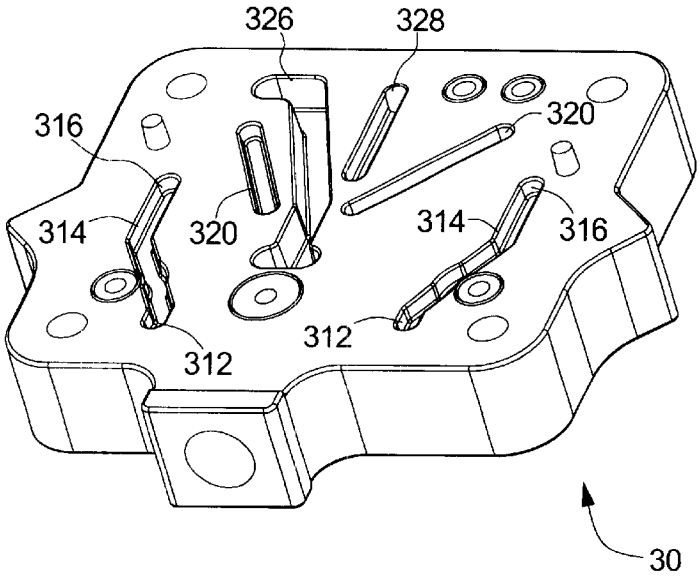
FIG. 11 is a perspective view of the metering assembly of FIG. 9 illustrating the various fluid channels associated therewith.
Figure 12:
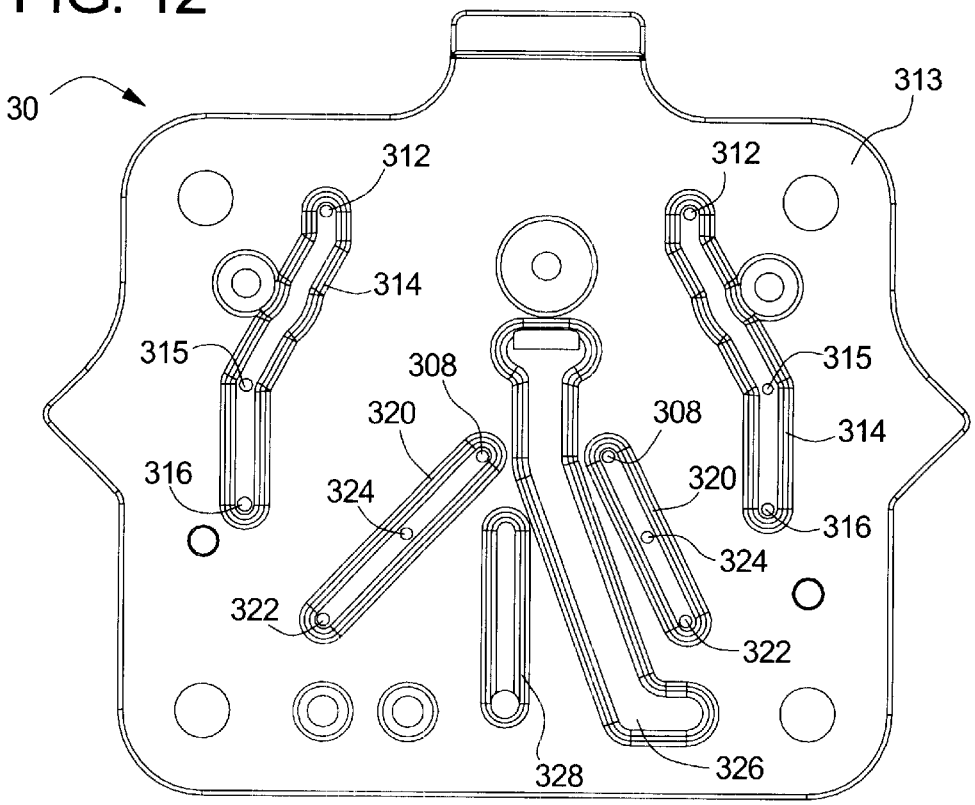
FIG. 12 is a top plan view of the metering assembly of FIG. 11.

Now, with particular reference to FIGS. 11–12, a top surface 313 of fuel metering assembly 30 is more particularly seen. A plurality of channels are cast or machined into top surface 313 of fuel metering assembly 30. Each of these channels serves a respective cylinder under a particular operating condition. Each barrel to the carburetor is served by three fluid circuits, namely, an "idle circuit", a "transfer circuit" and a "main circuit" (described below). The separate circuits permit tuning and calibration of the two barrels of the carburetor independently in response to the specific needs of the two cylinders. The "circuits" are a combination of emulsion tubes, air bleeds, and channels for properly mixing and directing the air and fuel. The channels in top surface 313 of fuel metering assembly 30 constitute a portion of the fluid circuits serving the respective cylinders.

Figure 13:
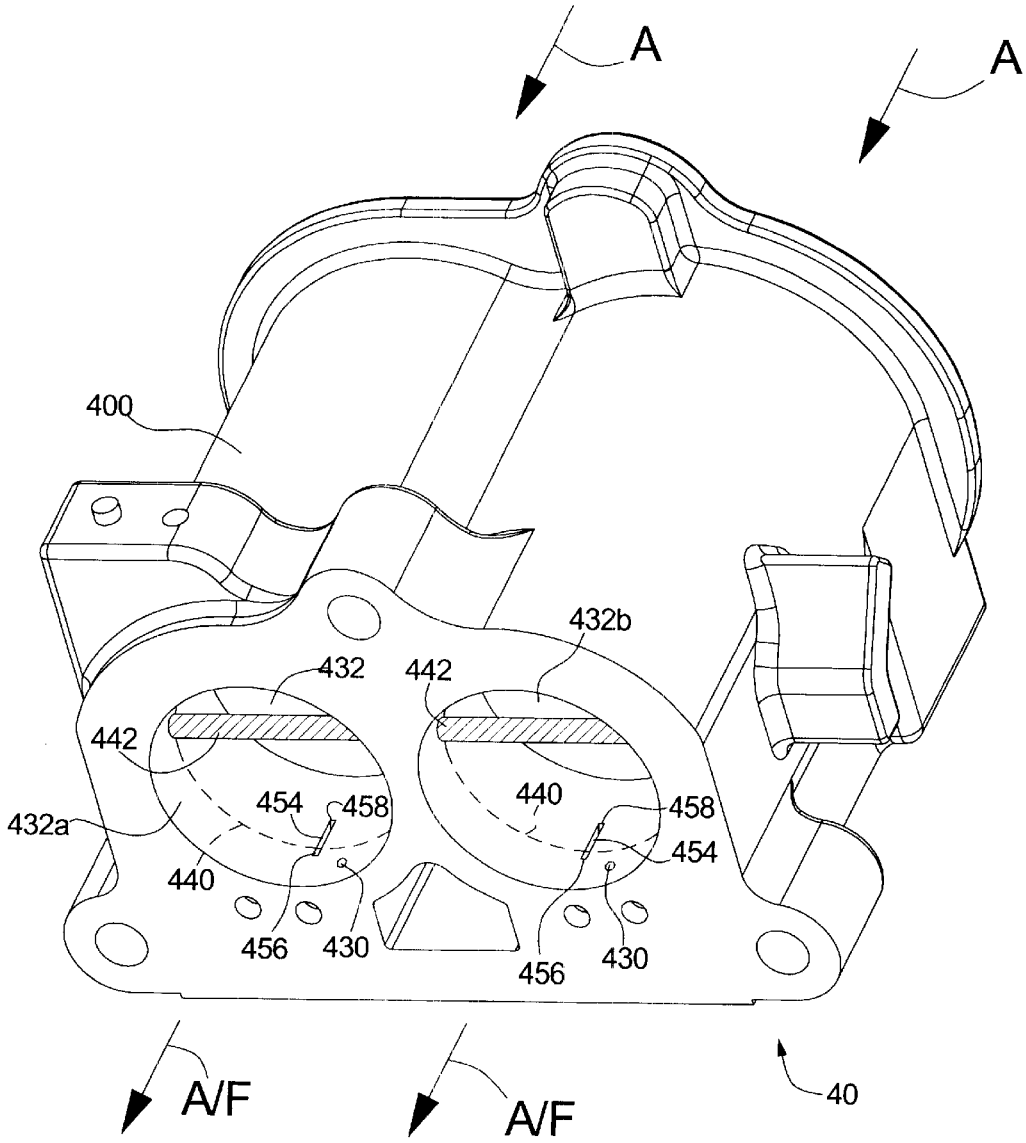
FIG. 13 is a perspective of an example of the main body assembly according to preferred embodiments.

Outer channels 314 on metering assembly 30 form a portion of the "idle circuit." The "idle circuit" is the circuit through which fuel flows during idling conditions of the motorcycle. Idle tubes 310 (FIGS. 9–10) are in fluid communication with channels 314 by virtue of holes 312 extending through metering assembly 30. Fuel is drawn through idle tubes 310 by the vacuum created in the idle circuit. One end of the "idle circuit" has a discharge port 430 (FIG. 13) which opens downstream of the carburetor's throttle plates 440 (FIG. 13). During low engine operating conditions, the carburetor's throttle plates 440 are substantially closed. Consequently, a relatively large vacuum is generated on the downstream side of the throttle plates 440. Discharge port 430 to the idle circuit is influenced by this vacuum. Specifically, as a result of the vacuum, fuel is sucked from bowl basin 204 into channels 314 (FIGS. 11–12), whereupon the fuel enters the fluid passages extending between channels 314 and the downstream side of the carburetor's throttle plates 440. This fuel powers the engine during low operating conditions of the motorcycle, e.g., during idling. Air bleed passages are formed in main body assembly 40. The air bleed passages open into channels 314 (FIG. 12) at approximately points 316. The air bleed passages formed in main body assembly 40 permit selective adjustment of the idle operating conditions by virtue of interchangeable idle air bleeds 414 (FIG. 2) associated with the inlet side of main body assembly 40.

When the rider demands further power of the motorcycle, the throttle handle is further twisted, which further opens throttle plates 440. This further opening of throttle plates 440 initiates fuel delivery through the "transfer circuit." The "transfer circuit" serves as a transition circuit between idling and booster venturi operation. The "transfer circuit" thus smoothes the power curve as the motorcycle begins to accelerate. The "transfer circuit" operates as an intermediate fuel delivery circuit as throttle plate 440 is opened. In other words, beyond a certain throttle opening, the idle circuit does not contribute enough fuel to the engine for stable operation. However, the pressure developed in induction passage 432 (the main passage through main body assembly 40, FIG. 13) is not sufficient to activate booster venturi 404 (FIG. 2). Consequently, the transfer circuit activates and continues operating until the pressure is induction passage 432 is sufficient to initiate fuel delivery through booster venturi 404. The structure and operation of the transfer circuit is described in more detail below in connection with the description of main body assembly 40.

Now, turning to the "main circuit", angled channels 320 (FIG. 12) respectively serve one of the two booster venturis, 404 (FIG. 2). Channels 320 include openings 308 into which main jet tubes 304 are inserted. The terminal end of the booster venturi feed line from the "main circuit" opens into channels 320 at approximately point 322. The booster venturi feed line is formed in main body assembly 40, described below. The "main circuit" also includes air bleeds. The distal end of the air bleed passage for the "main circuit", which are also formed in the main body assembly 40, open into channels 320 at approximately point 324. The high speed air bleeds 412 (FIG. 2) are interchangeable for fine-tuning the amount of the air bled off during "main circuit" operation. Finally, top surface 313 of metering assembly 30 also includes a choke channel 326 and an accelerator pump channel 328.

Moving next to the description of main body assembly 40, with reference to FIGS. 13–18, in conjunction with FIGS. 1–5, main body assembly 40 includes a main body 400 in which the subcomponents of main body assembly 40 are housed. Namely, as seen for example in FIG. 2 main body 400 includes main venturis 402 and booster venturis 404. These venturis are constrictions in the air flow passages which create a pressure drop. Consequently, as the air flows across the venturis, the air is accelerated, which facilitates the aspiration of fuel droplets into the air prior to delivery to the engine's cylinders. Main body 400 has two principal air induction passages 432, each respectively associated with the one of main venturis 402. Air induction passages 432 extend in parallel with one another through the main body assembly 40, but are isolated from one another. That is, the air flowing through main venturi 402 on the right side in FIG. 2 is substantially isolated from the air flowing through main venturi 402 illustrated on the left side of FIG. 2. However, a communication path could be provided between induction passages 432 to allow the pressure in the respective barrels to equalize.

Each booster venturi 404 is mounted on a post 406 attached to an interior wall of main body 400. Booster venturis 404 and associated fluid feed paths are substantially identical, so a description of one will serve to describe both. In addition to serving as a foothold for booster venturi 404, post 406 has a fuel feed passage (illustrated in phantom) formed therein. This fuel feed passage leads to an annulus 408 forming booster venturi 404. Annulus 408 has a plurality of outlet ports therearound. These outlet ports supply fuel to main body 40 during normal cruising conditions. Consequently, by virtue of having outlet ports formed around annulus 408 of booster venturi 404, an even distribution of fuel is provided around annulus 408 while the main circuit operates. This in turn provides a more controlled aspiration of fuel into the air supply.

Fuel is supplied to the interior of posts 406 from channels 320 (FIGS. 11–12). More particularly, with reference to FIG. 14, the bottom of main body assembly 40 is illustrated. Through-holes 410 are machined through main body 40. The fluid channels within posts 406 are in fluid communication with through-holes 410. Through-holes 410 mate with channels 320 (FIGS. 11–12) at approximately points 322. During normal cruise conditions, i.e., when throttle valve 440 is open, air flowing across booster venturi 404 and more specifically air flowing through annulus 408, creates a pressure drop across annulus 408. This pressure drop creates a suction effect which tends to draw fuel from channels 320. This fuel is delivered to through-holes 410 (FIG. 14), into the communication passages formed in the posts 406, and finally to annulus 408, where the fuel is introduced and aspirated into the air supply flowing through induction passage 432.

As mentioned previously, a pair of booster venturis 404 and interchangeable high speed air bleeds 412 (FIG. 2) are also provided. High speed air bleeds 412 may interchanged to fine-tune the performance of the booster venturis 404. The high speed air bleeds 412 are in fluid communication with channels 320 (FIGS. 11–12) at approximately points 324. The high speed air bleed passage "short-circuits" the suction created by booster venturis 404 to reduce the amount of fuel which would be delivered to booster venturis 404 if the air bleeds were not provided.

An idle air bleed 414 (FIG. 2) is also provided. The idle air bleed 414 is also interchangeable to fine-tune the performance of the idle circuit. Idle air bleed 414 is in fluid communication with channels 314 (FIGS. 11–12) at approximately points 316. The idle air bleed passage also "short circuits" the suction created by idle discharge port 430 (FIG. 13) to reduce the amount of fuel which would be delivered to idle discharge port 430.

A pair of accelerator pump discharge nozzles 420 (FIG. 2) are mounted between air bleeds 412, 414. Accelerator pump discharge nozzle 420 is in fluid communication with channel 328 (FIGS. 11–12). Upon demanded acceleration, accelerator pump assembly 270 (FIG. 6) is actuated by virtue of the rider twisting the accelerator handle. This in turn pumps fluid into channel 328. The fluid in channel 328 is delivered to accelerator pump discharge nozzle 420 as raw fuel. Although the raw fuel is not aspirated, the quick wrist-turn associated with acceleration often does not provide enough time for the fuel to be properly aspirated through either of the three fluid circuits. Consequently, the raw fuel allows the bike to accelerate (or rev while in neutral) substantially instantaneously in response to the rider's demand, without bucking or stalling due to an inadequate fuel supply. Advantageously, a hold down screw 422 (FIG. 2) is associated with the accelerator pump discharge nozzle 420. Accelerator pump discharge nozzle 420 is interchangeable to permit selective adjustment of the fuel delivered upon demanded acceleration or revving, again permitting the fine-tuning of the fuel delivery for optimum performance of the engine.

Referring again to FIG. 14 where the bottom side of main body assembly 40 is illustrated, the "idle circuit" and the "transfer circuit" are shown. The idle circuit includes a pair of openings 432 formed in the bottom of main body assembly 40. Openings 432 preferably have screw-in brass fittings 434 placed therein during production. Fittings 434 are restrictions in the idle circuit communication passage extending through main body assembly 40. According to preferred embodiments, fittings 434 are designed in several sizes. These sizes permit the selective adjustment of the idle circuit feed for different applications. For instance, a more powerful bike, i.e., one with more horsepower, could require less restriction than a bike with less horsepower. The interchangeable fittings permit the carburetor of the preferred embodiments to be "tuned" to the performance characteristics of the particular bike.

Figure 14:
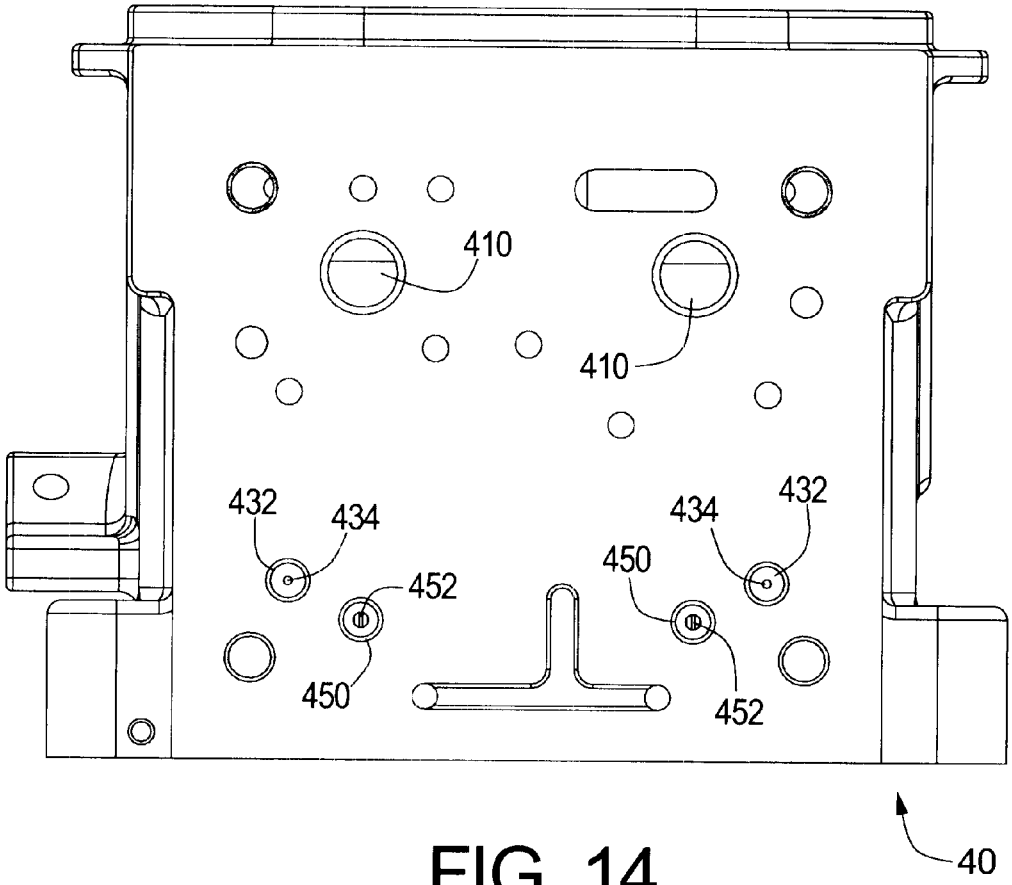
FIG. 14 is a bottom plan view of the main body assembly of FIG. 13 illustrating various fluid channels which communicate with the channels of the metering body illustrated in FIGS. 11 and 12.

As mentioned previously, the "idle circuit" terminates at idle discharge port 430 (FIG. 13). Idle discharge port 430 is positioned downstream of throttle plates 440. That is, air flows in the direction of arrows A through main body assembly 40. Consequently, when throttle plates 440 are closed, i.e., when the bike is idling, a large vacuum is created in intake manifold assembly 50 (located between the closed throttle plates 440 and the intake to the cylinders). This suction causes fuel to be sucked though idle tubes 310 (FIGS. 9–10), into channels 314 (FIGS. 11–12) and into main body assembly 40 through openings 432 (FIG. 14).

Fuel is delivered through the idle circuit in the proportion to which it has been calibrated at the factory, i.e., based on the size of idle circuit fittings 434 (FIG. 14) and based on the adjustment of idle air bleed 414 (FIG. 2).

Now, referring once again to FIG. 14, the "transfer circuit" includes a pair of openings 450 formed in the bottom of main body assembly 40. Openings 450 preferably also have screw in brass fittings 452 placed therein during production. Fittings 452 form restrictions in the "transfer circuit" communication passage which extends through main body assembly 40. According to the preferred embodiments, fittings 452 are designed in several sizes. These sizes permit the selective adjustment of the transfer circuit feed for different applications. For instance, a more powerful bike, i.e., one with more horsepower, could require less restriction than a bike with less horsepower. The interchangeable fittings permit the carburetor of the preferred embodiment to be "tuned" to the performance characteristics of the particular bike.

The "transfer circuit" terminates at transfer circuit discharge port 454 (FIG. 13). Transfer circuit discharge port 454 is preferably slot-shaped, but other shapes are contemplated within the preferred embodiments. The slot-like opening to transfer circuit discharge port 454 has two ends 456, 458. As throttle plate 440 is opened in response to rider-demanded acceleration or revving, first end 456 of transfer discharge port 454 is exposed. As throttle plate 440 is further opened, more of transfer circuit discharge port 454 is exposed. Eventually, as throttle plate 440 is further opened, the entire transfer circuit discharge port 454 is exposed to the suction pressure in manifold assembly 50. Consequently, as throttle plate 440 is opened, more fuel is delivered through the "transfer circuit" until the suction in the "transfer circuit" is overtaken by the suction created in booster venturi 404. At that point, booster venturi 404 takes control and no more fuel is delivered through the transfer circuit discharge port 454.

Air flows in the direction of arrows A (FIG. 13) through main body assembly 40. Upon opening of throttle plate 440, transfer circuit discharge port 454 creates a suction which draws fuel through idle tube 310 (FIGS. 9–10) into channel 314 (FIGS. 11–12). From there, the transfer circuit delivers fuel into main body assembly 40 through opening 450 (FIG. 14). Fuel is delivered through the transfer circuit in the proportion to which the circuit has been calibrated at the factory based on the size of transfer circuit fittings 452 (FIG. 14) and based on the adjustment of idle air bleed 414 (FIG. 2).

Figure 15:
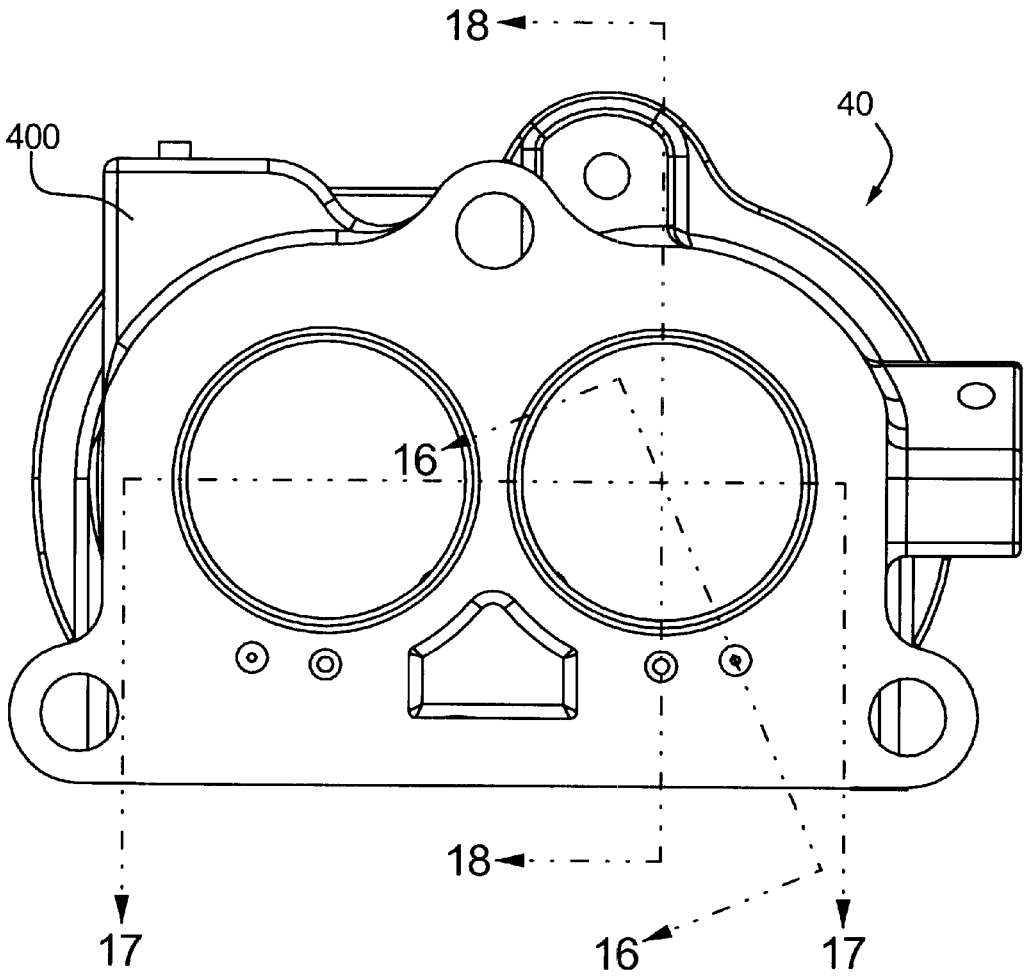
FIG. 15 is a rear elevational view of the main body assembly of FIG. 13.
Figure 16:
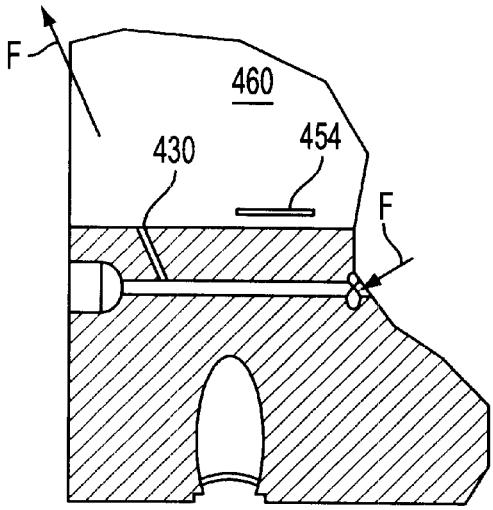
FIG. 16 is a partial cross sectional view taken along lines 16—16 in FIG. 15.
Figure 18:
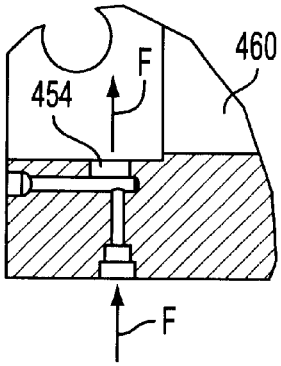
FIG. 18 is a partial cross sectional view taken along lines 18—18 in FIG. 15.
Figure 17:
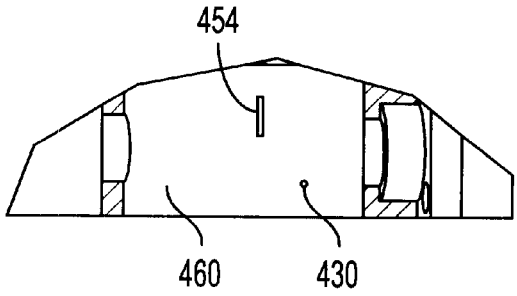
FIG. 17 is a partial cross sectional view taken along lines 17—17 in FIG. 15.

The transfer circuit operates as an intermediate fuel delivery circuit as throttle plates 440 are opened. That is, at a certain point during opening of throttle plates 440, the "transfer circuit" overtakes the "idle circuit" and the "idle circuit" ceases delivering fuel. This phenomenon is best illustrated in FIGS. 15–18. FIG. 15 illustrates main body assembly 40 from the rear side thereof. Several sections are taken through FIG. 15 to illustrate the interaction between the idle circuit and the transfer circuit. FIG. 16 is a section taken along lines 16—16 in FIG. 15. FIG. 17 is a section taken along lines 17—17 in FIG. 15. Finally, FIG. 18 is a section taken along lines 18—18 in FIG. 15.

Referring collectively to FIGS. 16–18, the interior barrel to the carburetor is represented by 460. Fuel flows through respective idle and transfer circuits in the direction of arrow F. The "idle circuit" and the "transfer circuit" draw fuel from the same supply line. As the pressure at transfer circuit discharge port 454 increases, it eventually exceeds that in the idle circuit. Consequently, idle circuit discharge port 430 eventually ceases discharging fuel, whereupon fuel is pulled through the main body by virtue of the pressure created at transfer circuit discharge port 454. A seamless "transfer" of power is thus provided by the transfer circuit between idling and the point when booster venturi 404 takes over the fuel delivery.

Figure 19:
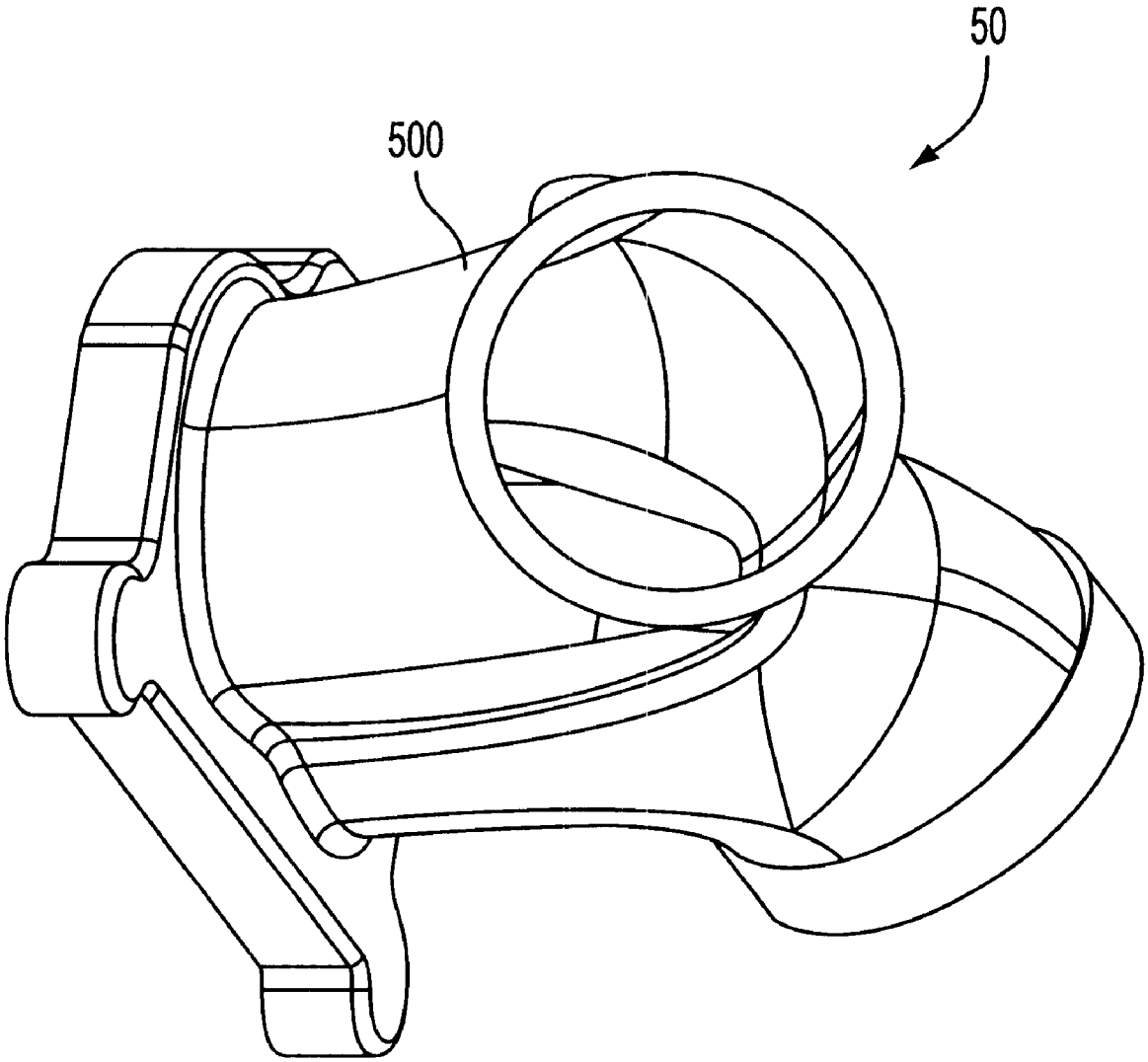
FIG. 19 is a perspective view of an example of the plenum manifold assembly according to the preferred embodiments.
Figure 20:
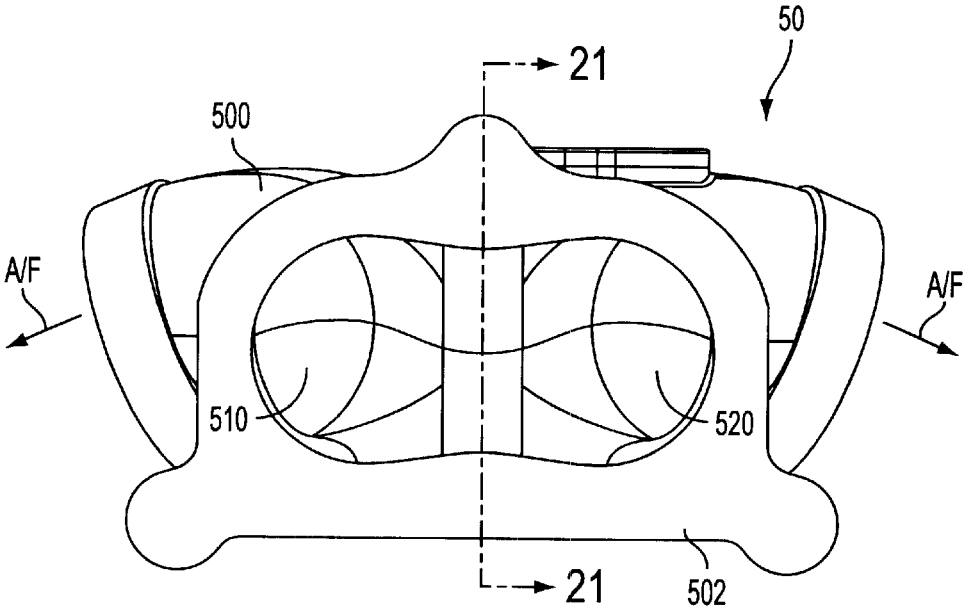
FIG. 20 is a front elevational view of the plenum manifold assembly of FIG. 19.
Figure 21:
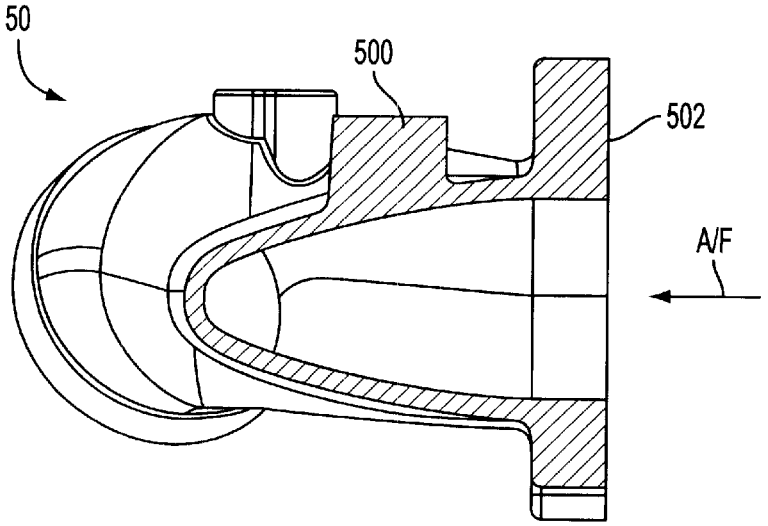
FIG. 21 is a cross sectional view of the plenum manifold assembly taken along lines 21—21 in FIG. 20.

Turning now to the final subassembly of carburetor 10, plenum manifold assembly 50, reference is made to FIGS. 19–21, in conjunction with FIGS. 1–5. As best seen in FIG. 19, plenum manifold assembly 50 includes a manifold body 500 whose front face 502 is operatively connected to the outlet side of main body assembly 40. The manifold body 500 includes two passages 510, 520 formed therein. Each of manifold passages 510, 520 serves respective cylinders. The air/fuel mixture flows in the direction of arrow A/F through manifold body assembly 50. Advantageously, manifold passages 510, 520 are in fluid communication with one another.

As mentioned previously, parallel induction passages 432 extending through main body assembly 40 are not in fluid-communication with one another. The isolation in main body assembly 40 is compensated for by the provision of communication between manifold passages 510, 520. The communication between passages 510, 520 is accomplished by the absence of a wall between the two passages 510, 520. Alternatively, the communication between passages 510, 520 could be provided by a wall extending therebetween and having one or more communication ports allowing fluid communication between the two passages.

As the air/fuel mixture A/F leaves the respective induction passages within main body 40, it is generally directed rearwardly into respective manifold passages 510, 520. Given the speed with which the A/F mixture exits main body assembly 40, the A/F mixture tends to continue along the same generally parallel path as it enters manifold assembly 50. Consequently, the A/F mixture exiting the right carburetor barrel tends to service the right manifold passage 520 whereas the A/F mixture exiting the left carburetor barrel tends to service the left manifold passage 510. As manifold passages 510, 520 approach their respective ends, they diverge and angle away from each other. However, the communication path between manifold passages 510, 520 permits one manifold to "borrow" from the other under different operating conditions. This feature is particularly advantageous because, as discussed previously, the cylinders of a dual cylinder bike tend to operate under different conditions. Thus, despite the best efforts to "tune" the carburetor to satisfy the different operating characteristics of the respective cylinders, the communication path between manifold passages 510, 520 operates as a final opportunity for the A/F mixture to be optimized before delivery to the combustion chambers.

Plenum manifold assembly 50 also includes a vacuum pick up tube 530 (FIG. 1) operatively connected to a fuel shut-off sensor and a manifold absolute pressure sensor 540 (BOSS MAP). These sensors monitor the manifold pressure. The driver may have gauges indicative of each. Optionally, information from tube 530 and sensor 540 could be sent to a microcontroller to further optimize the fuel delivery.

Without being limited to any theory of operation, it is believed that the provision of a communication path between the cylinders provides unique advantages, not the least of which is the increased horsepower which has been observed on a dynamometer.

Other accessories and external linkages are associated with carburetor 10. For instance, with reference to FIG. 13, a throttle valve shaft 442 extends across the induction passages. Throttle plates 440 are operatively connected to throttle valve shaft 442. The first throttle plate 440 is disposed on valve shaft 442 within first induction passage 432*a* and the second throttle plate 440 is disposed on valve shaft 442 within second induction passage 432*b*. Shaft 442 is mechanically connected to a throttle assembly 60 (FIG. 3) of the motorcycle.

Namely, throttle assembly 60 includes a throttle wheel 61 which is operatively connected to the wrist throttle associated with the handle-bars to the motorcycle. Throttle wheel 61 is operatively connected to push rod 62 through cam follower 64. A roller bearing 610 is secured to the outer perimeter of throttle wheel 61. Roller bearing 610 rolls against an extension arm 640 formed on cam follower 64. Cam follower 64 is rotatably attached to main body assembly 40 by a pin 642. The push rod 62 includes an adjusting screw 620 for adjusting the sensitivity of the accelerator pump in response to the hand-operated throttle. A compression spring 622 normally biases push rod 62 upwardly so that the accelerator pump is not activated to discharge a burst of raw fuel.

Figure 4:
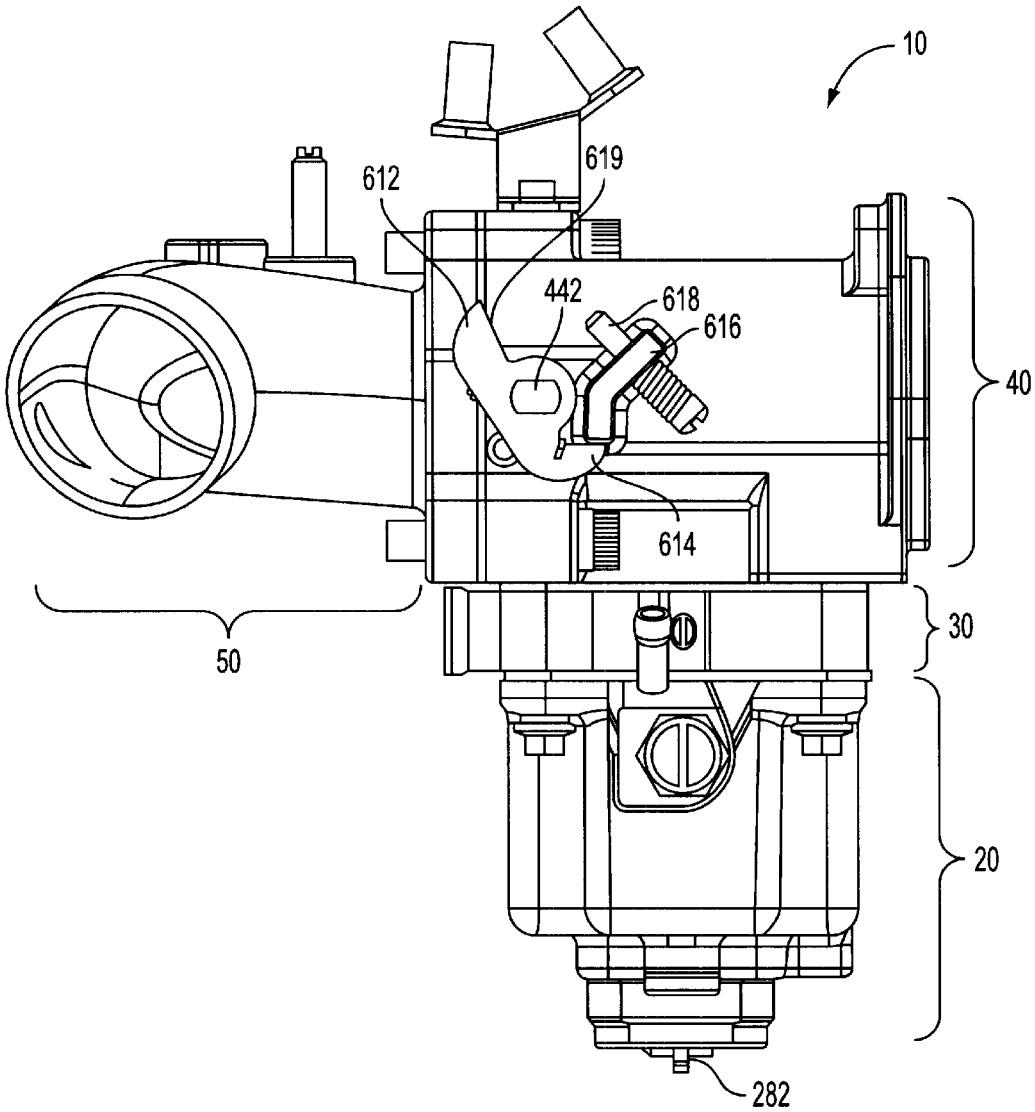
FIG. 4 is a left side view of the carburetor assembly of FIG. 1.
Figure 5:
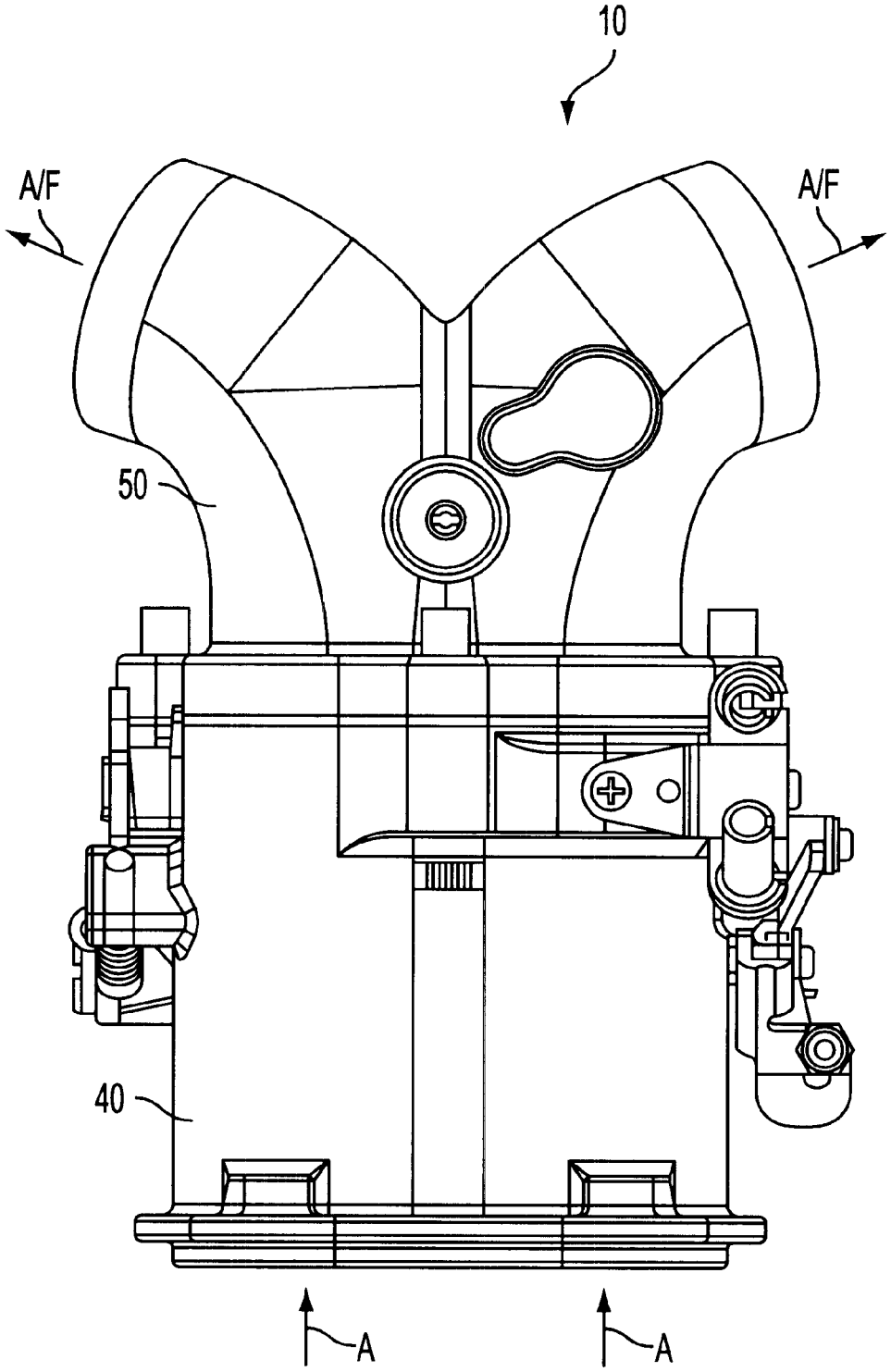
FIG. 5 is an overhead view of the carburetor assembly of FIG. 1.

With reference to FIG. 4, further features of throttle assembly 60 are apparent. Namely, one terminal end of throttle valve shaft 442 is operatively connected to a wide open throttle stop lever 612. Stop lever 612 rotates simultaneously with throttle plates 440. Stop lever 612 is provided with a positive stop 614. Stop lever 612 illustrated in FIG. 4 is shown in the wide open throttle position. That is, stop lever 612 is prevented from further rotation by virtue of the contact between positive stop 614 and a throttle limiter 616. Throttle limiter 616 also includes an adjustable idle set screw 618 which, when the motorcycle is idling (i.e., when throttle plates 440 are closed), engages positive stop 619 on stop lever 612.

Figure 3:
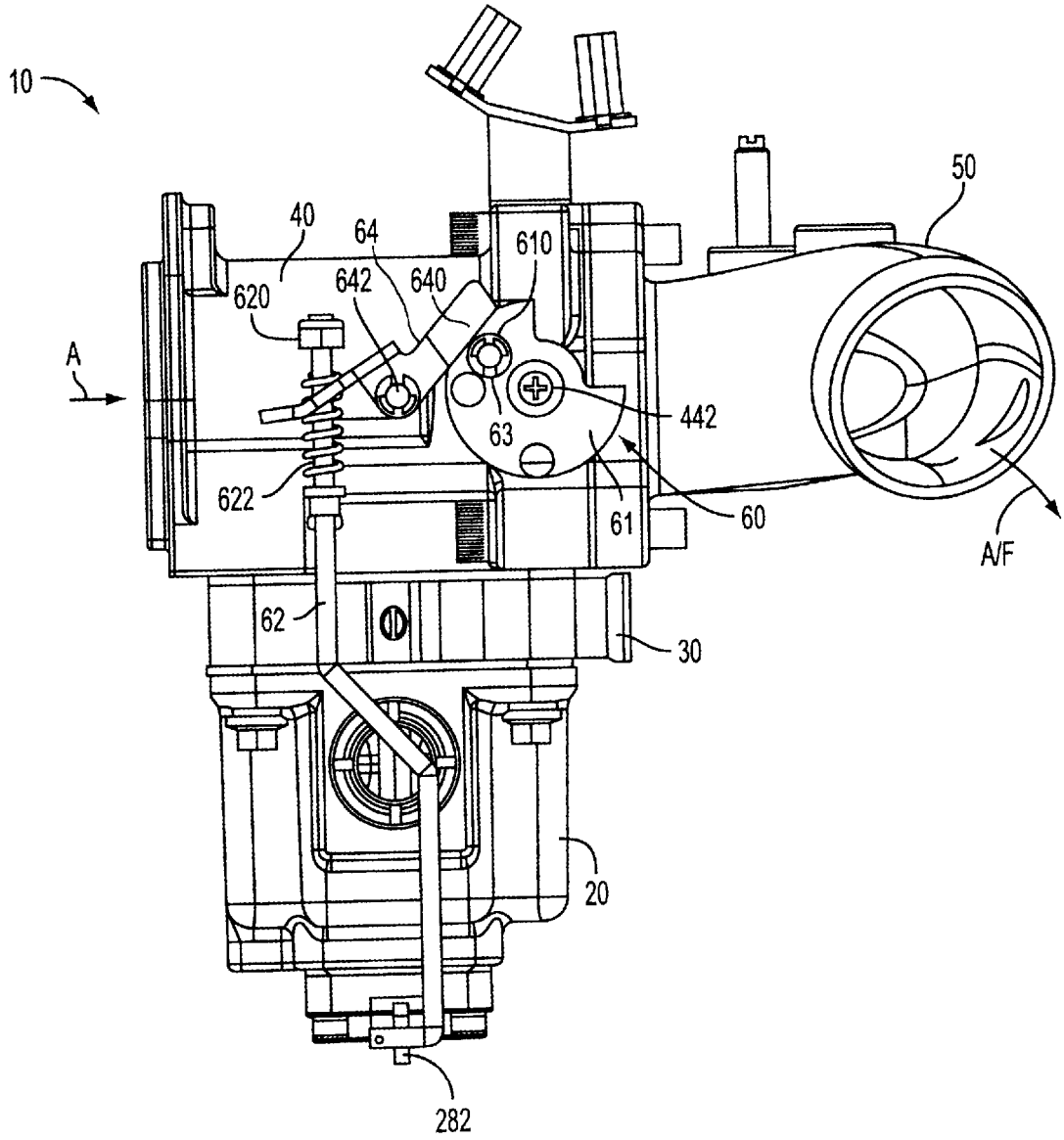
FIG. 3 is a right side view of the carburetor assembly of FIG. 1.

With reference to FIGS. 3 and 4, the operation of the accelerator is more particularly understood now that the components of throttle assembly 60 have been described. Namely, upon actuation of the hand throttle, the cables extending between the hand throttle and throttle wheel 61 cause throttle wheel 61 to rotate. This rotation is transmitted to throttle valve shaft 442 to which throttle plates 440 are operatively connected. As seen in FIG. 4, upon driver initiated acceleration or revving in neutral, wide open throttle stop lever 612 governs the extent to which throttle plates 440 may be opened. Positive stop 614 engages throttle limiter 616 to prevent over-revving of the engine.

When the rider demands instantaneous acceleration, roller 63 on throttle wheel 61 compresses the compression spring 622 by causing cam follower 64 to rotate in the counterclockwise direction. This in turn causes push rod 62 to be actuated downwardly. This downward actuation is in turn transmitted to accelerator pump linkage 282. Diaphragm assembly 276 (FIG. 6) is thus compressed, delivering a burst of fuel to accelerator pump discharge nozzles 420 (FIG. 2).

As will now be appreciated, the carburetor assembly of the preferred embodiments 10 is an integral part of a motorcycle engine. Outside air is taken into the motorcycle's air filter assembly. The filtered air passes from the air filter assembly into carburetor assembly 10 via induction passages 432. The air passes into main body air passages and is constricted by main venturis 402 creating a pressure drop compared to atmospheric pressure and the pressure within the fluid channels of metering assembly 30. Booster venturis 404 create a further constriction for the air to flow through and thus create a further pressure drop. Fuel enters bowl assembly 20 from the motorcycle's fuel tank 202. The fuel fills bowl basin 204 to a predetermined point based on the adjustable float assembly 208. Fuel is then drawn into metering assembly 30, and is mixed with air from the various air bleeds to emulsify and aspirate the fuel. The actual path of the fuel through metering assembly 30 is determined by the phase of motorcycle operation. The emulsified and aspirated fuel is discharged into main body induction passages 432 via one or more fuel discharge ports. The fuel/air mixture flow through main body induction passages 432 and into plenum manifold 50 is controlled by throttle plates 440 attached to throttle valve shaft 442. Valve shaft 442 is actuated by a mechanical connection to the motorcycle's throttle assembly 60. In response to the throttle control, fuel/air mixture is fed into first and second induction passages 432 where the mixture is then delivered to the engine's combustion chambers and power is provided to the motorcycle's engine.

Figure 22:
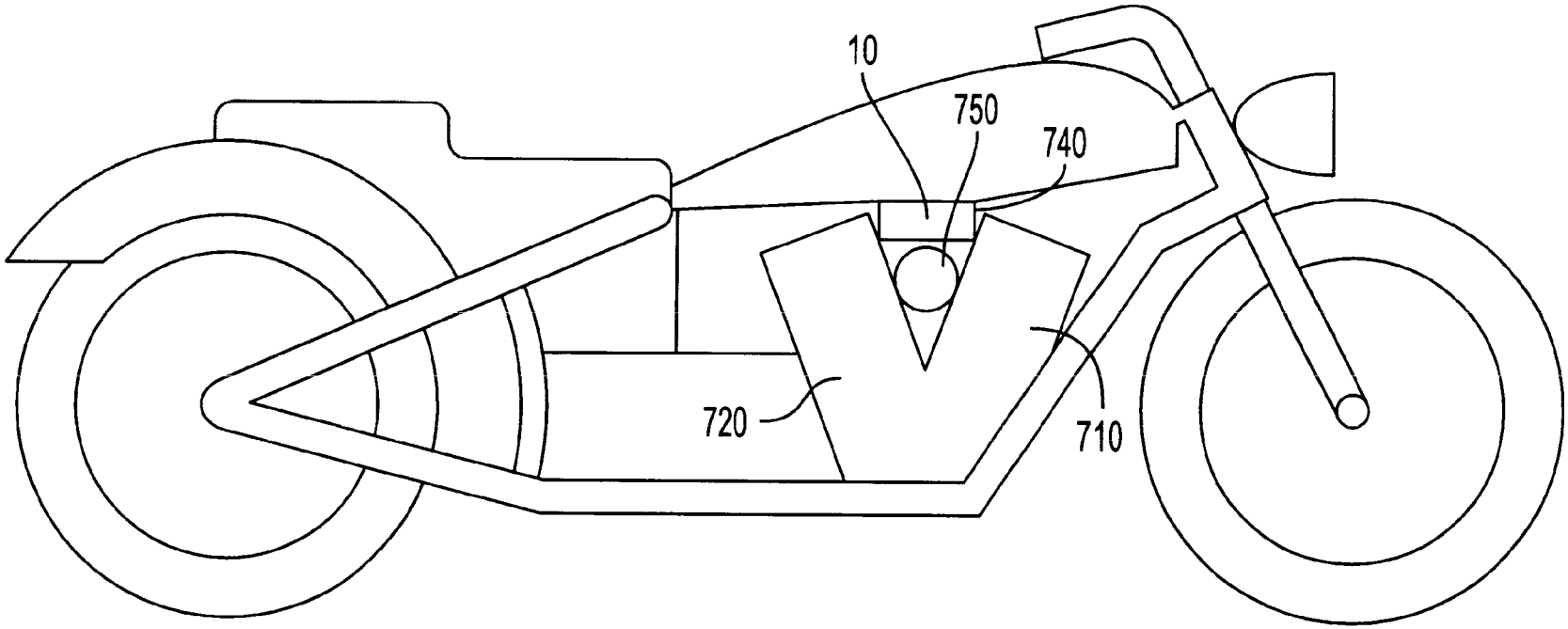
FIG. 22 is a side view of a motorcycle in accordance with an embodiment of the invention.

FIG. 22 is a side view of a motorcycle in accordance with an embodiment of the invention. The motorcycle includes first cylinder assembly 710, second cylinder assembly 720, throttle assembly 740, air filter assembly 750 and carburetor assembly 10. FIG. 22 is merely one example of the motorcycle of the invention. It is noted that many other configurations of motorcycles, including those with more than two cylinders, are also part of the invention. While the examples given in the specification and drawings relate to a two cylinder application, it is noted that the invention can be adapted to engines having three or more cylinders.

This invention has been described in connection with preferred embodiments. These embodiments are intended to be illustrative only. It will be readily appreciated by those skilled in the art that modifications may be made to these preferred embodiments without departing from the scope of the invention.

What is claimed is:

1. A carburetor assembly for a motorcycle, comprising:

a main body having a first body passage having a first intake port, a first discharge port, and a first constriction between the first intake port and the first discharge port, the first discharge port for connecting to a first cylinder of the motorcycle;

a second body passage having a second intake port, a second discharge port, and a second constriction between the second intake port and the second discharge port, the second discharge port for connecting to a second cylinder of the motorcycle;

a first valve disposed within the first body passage between the first constriction and the first discharge port, the first valve operable to regulate airflow through the first body passage; and a second valve disposed within the second body passage between the second constriction and the second discharge port, the second valve operable to regulate airflow through the second body passage;

a fuel bowl assembly comprising a fuel intake valve and a fuel bowl body forming a reservoir;

at least one fluid channel connecting the reservoir to the first body passage and the second body passage; and a plenum manifold assembly connected to the first discharge port and the second discharge port.

2. The carburetor assembly of claim 1, wherein fuel enters the fuel bowl assembly through the fuel intake valve and accumulates in the reservoir, fuel is aspirated within the at least one fluid channel, the aspirated fuel is combined with air entering the first intake port and air entering the second intake port to form an air/fuel mixture, and the air/fuel mixture exits the first discharge port and the second discharge port.

3. The carburetor assembly of claim 1, wherein the plenum manifold assembly comprises:

a first manifold passage having a first cylinder discharge port and a first main body opening, the first main body opening engaging the main body at the first discharge port, the first body passage and the first manifold passage being substantially contiguous;

a second manifold passage having a second cylinder discharge port and a second main body opening, the second main body opening engaging the main body at the second discharge port, the second body passage and the second manifold passage being substantially contiguous; and a third manifold passage connecting the first manifold passage and the second manifold passage, wherein the first cylinder discharge port is for connecting to the first cylinder and the second cylinder discharge port is for connecting to the second cylinder.

4. The carburetor assembly of claim 1, wherein the main body further comprises:

a first booster venturi within the first body passage and within the first constriction, whereby the first booster venturi further restricts air flow through the first body passage; and a second booster venturi within the second body passage and within the second constriction, whereby the second booster venturi further restricts air flow through the second body passage.

5. The carburetor assembly of claim 4, wherein the first booster venturi further comprises at least one opening connected to the at least one fluid channel and the second booster venturi comprises at least one opening connected to the at least one fluid channel, whereby aspirated fuel is combined with air flowing through the first constriction and aspirated fuel is combined with air flowing through the second constriction.

6. The carburetor assembly of claim 5, wherein the first booster venturi comprises a first annular ring and the second booster venturi comprises a second annular ring.

7. The carburetor assembly of claim 6, wherein the at least one opening of the first booster venturi comprises a plurality of openings distributed around the first annular ring, and the at least one opening of the second booster venturi comprises a plurality of openings distributed around the second annular ring.

8. The carburetor of claim 7, wherein the plurality of openings distributed around the first annular ring are symmetrically distributed around the first annular ring and the plurality of openings distributed around the second annular ring are symmetrically distributed around the second annular ring.

9. The carburetor assembly of claim 1, wherein the fuel intake valve is a part of a fuel inlet and seat assembly.

10. The carburetor assembly of claim 9, wherein a position of the fuel inlet and seat assembly relative to the fuel bowl assembly is controlled externally of the fuel bowl assembly to adjust fuel level in the fuel bowl body.

11. The carburetor assembly of claim 10, wherein the fuel level in the fuel bowl body is adjustable externally of the fuel bowl body by controlling a position of the fuel intake valve relative to the fuel bowl body.

12. The carburetor assembly of claim 11, wherein the fuel intake valve is adjustable externally of the fuel bowl body by a screw and an adjusting nut assembly.

13. The carburetor assembly of claim 11, wherein the fuel intake valve is a needle and seat valve.

14. The carburetor assembly of claim 11, wherein the fuel bowl assembly further comprises an adjustable float in contact with the fuel intake valve, whereby a level of fuel in the fuel bowl body is adjusted.

15. The carburetor assembly of claim 14, wherein the fuel bowl assembly further comprises a transparent panel in the fuel bowl body, whereby the fuel level can be observed.

16. The carburetor assembly of claim 15, wherein the transparent panel is mounted in a plug, and the plug is inserted in the fuel bowl body.

17. The carburetor assembly of claim 1, further comprising at least one of the following: an idle circuit, a transfer circuit, a main metering circuit, and an accelerator pump circuit.

18. The carburetor assembly of claim 17, wherein the accelerator pump circuit comprises:

an accelerator pump assembly connected to the reservoir;

a means for activating the accelerator pump assembly;

a first accelerator pump discharge nozzle placed at the intake port of the first body passage;

a second accelerator pump discharge nozzle placed at the intake port of the second body passage; and an accelerator passage connecting the reservoir with the first accelerator pump discharge nozzle and the second accelerator pump discharge nozzle.

19. The carburetor assembly of claim 18, wherein the accelerator pump assembly further comprises an accelerator pump check valve supported by a return spring, the accelerator pump check valve and the return spring being located in a diaphragm, and a diaphragm cover enclosing the diaphragm.

20. The carburetor assembly of claim 19, wherein the means for activating the accelerator pump assembly comprises a diaphragm linkage connected to the diaphragm cover and a rod.

21. The carburetor assembly of claim 19, wherein the accelerator pump check valve comprises a needle nose which penetrates the reservoir.

22. The carburetor assembly of claim 17, further comprising a metering body assembly placed between the main body and the fuel bowl assembly, the metering body assembly being connected to the reservoir by at least one conduit.

23. The carburetor assembly of claim 22, further comprising a first idle circuit for the first body passage and a second idle circuit for the second body passage.

24. The carburetor assembly of claim 23, wherein the first idle circuit comprises:

at least one first idle circuit tube including one end connected to the metering body assembly and another end in communication with the reservoir; and at least one first idle circuit discharge port including an opening in the first body passage downstream of the first valve, the first idle circuit discharge port communicating with the metering body assembly.

25. The carburetor assembly of claim 24, wherein the second idle circuit comprises:

at least one second idle circuit tube including one end connected to the metering body assembly and another end in communication with the reservoir; and at least one second idle circuit discharge port including an opening in the second body passage downstream of the second valve, the second idle circuit discharge port communicating with the metering body assembly.

26. The carburetor assembly of claim 24, wherein the opening in the first body passage comprises changeable fittings to adjust a size of the opening.

27. The carburetor assembly of claim 25, wherein the opening in the second body passage comprises changeable fittings to adjust a size of the opening.

28. The carburetor assembly of claim 22, further comprising a first transfer circuit for the first body passage and a second transfer circuit for the second body passage.

29. The carburetor assembly of claim 28, wherein the first transfer circuit comprises a first slot-shaped transfer circuit discharge port connected to the reservoir through the metering body assembly and including a first and a second end, the first slot-shaped transfer circuit discharge port placed in the vicinity of the first valve so that upon an initial opening of the first valve, the first end of the first slot-shaped transfer circuit discharge port is exposed to the airflow, and when the first valve is fully opened, the second end of the first slot-shaped transfer circuit discharge port is exposed to the airflow.

30. The carburetor assembly of claim 29, wherein the second transfer circuit comprises a second slot-shaped transfer circuit discharge port connected to the reservoir through the metering body assembly and including a first and a second end, the second slot-shaped transfer circuit discharge port placed in the vicinity of the second valve so that upon an initial opening of the second valve, the first end of the second slot-shaped transfer circuit discharge port is exposed to the airflow, and when the second valve is fully opened, the second end of the second slot-shaped transfer circuit discharge port is exposed to the airflow.

31. The carburetor assembly of claim 22, wherein the main metering circuit has a first metering circuit for the first body passage and a second metering circuit for the second body passage.

32. The carburetor assembly of claim 22, wherein the idle circuit comprises a first idle circuit channel and a second idle circuit channel, the first and second idle circuit channels being in a surface of the metering body assembly.

33. The carburetor assembly of claim 32, wherein the main metering circuit comprises a first main metering circuit channel and a second main metering circuit channel, the first and second main metering circuit channels being in a surface of the metering body assembly.

34. The carburetor assembly of claim 33, wherein the transfer circuit comprises a transfer circuit channel, the transfer circuit channel being in a surface of the metering body assembly.

35. The carburetor assembly of claim 34, wherein the accelerator pump circuit comprises an accelerator pump circuit channel, the accelerator pump circuit channel being in a surface of the metering body assembly.

36. A motorcycle, comprising:

a first cylinder assembly;

a second cylinder assembly;

a throttle assembly;

an air filter assembly; and a carburetor assembly, the carburetor assembly comprising:

a main body, the main body having a first body passage having a first intake port, a first discharge port, and a first constriction between the first intake port and the first discharge port, the first intake port being adjacent the air filter assembly;

a second body passage having a second intake port, a second discharge port, and a second constriction between the second intake port and the second discharge port, the second intake port being adjacent the air filter assembly;

a first valve disposed within the first body passage between the first constriction and the first discharge port, the first valve operably connected to the throttle assembly to regulate airflow through the first body passage;

a second valve disposed within the second body passage between the second constriction and the second discharge port, the second valve operably connected to the throttle assembly to regulate airflow through the second body passage;

a fuel bowl assembly comprising a fuel intake valve and a fuel bowl body forming a reservoir;

at least one fluid channel connecting the reservoir to the first body passage and the second body passage; and a plenum manifold assembly, the plenum manifold assembly comprising:

a first manifold passage having a first cylinder port and a first main body opening, the first main body opening engaging the main body at the first discharge port of the first body passage, the first body passage and the first manifold passage forming a substantially contiguous first passageway, and the first cylinder discharge port connecting to the first cylinder assembly; and a second manifold passage having a second cylinder discharge port and a second main body opening, the second main body opening engaging the main body at the second discharge port of the second body passage, the second body passage and the second manifold passage forming a substantially contiguous second passageway, and the second cylinder discharge port connecting to the second cylinder assembly.

37. The motorcycle of claim 36, wherein the plenum manifold assembly further comprises a third manifold passage connecting the first manifold passage and the second manifold passage.

* * * * *